US010747141B2

(12) United States Patent
Shiomi et al.

(10) Patent No.: US 10,747,141 B2
(45) Date of Patent: Aug. 18, 2020

(54) DEVELOPING DEVICE

(71) Applicant: CANON KABUSHIKI KAISHA, Tokyo (JP)

(72) Inventors: Tomohiro Shiomi, Abiko (JP); Teruaki Tsurusaki, Moriya (JP); Shunichi Koga, Abiko (JP); Masafumi Takahashi, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/694,576

(22) Filed: Nov. 25, 2019

(65) Prior Publication Data

US 2020/0183300 A1 Jun. 11, 2020

(30) Foreign Application Priority Data

Dec. 5, 2018 (JP) ..... 2018-228343

(51) Int. Cl.
*G03G 15/08* (2006.01)
*G03G 21/16* (2006.01)

(52) U.S. Cl.
CPC ..... *G03G 15/0812* (2013.01); *G03G 15/0813* (2013.01); *G03G 15/0818* (2013.01); *G03G 15/0891* (2013.01); *G03G 21/1647* (2013.01)

(58) Field of Classification Search
CPC ..... G03G 15/0812; G03G 15/0813; G03G 15/0818; G03G 15/0891; G03G 21/1647; G03G 21/1676
USPC ..... 399/107, 110, 111, 119, 120, 252, 265, 399/267, 274, 279, 284
See application file for complete search history.

(56) References Cited

U.S. PATENT DOCUMENTS

| | | | | |
|---|---|---|---|---|
| 8,831,487 | B2 * | 9/2014 | Kashiide | G03G 15/0812 399/126 |
| 8,948,665 | B2 * | 2/2015 | Kase | G03G 15/0812 399/284 |
| 9,989,883 | B2 * | 6/2018 | Okuda | G03G 15/0812 |
| 10,054,877 | B2 * | 8/2018 | Mizukoshi | G03G 15/0812 |
| 10,386,743 | B2 * | 8/2019 | Sakamaki | G03G 15/0812 |

FOREIGN PATENT DOCUMENTS

| | | | |
|---|---|---|---|
| JP | H08185045 | A | 7/1996 |
| JP | 2005134480 | A | 5/2005 |
| JP | 2014197175 | A | 10/2014 |

* cited by examiner

*Primary Examiner* — Hoan H Tran
(74) *Attorney, Agent, or Firm* — Canon U.S.A., Inc. IP Division

(57) ABSTRACT

When a developing device is seen in a cross section orthogonal to a rotation axis of a rotatable developing member, a resin-made regulating blade has a cutout over an entirety of a region from a first position where the regulating blade is closest to the rotatable developing member to a second position 0.5 mm downstream of the regulating blade from the first position in a rotation direction of the rotatable developing member, and a cut amount of the cutout at the second position is 0.3 mm or more.

7 Claims, 18 Drawing Sheets

COMPARATIVE EXAMPLE

COMPARATIVE EXAMPLE

DEVELOPING DEVICE

BACKGROUND OF THE DISCLOSURE

Field of the Disclosure

The present disclosure relates to a developing device including a resin-made regulating blade.

Description of the Related Art

A developing device includes a developing device frame, a rotatable developer bearing member (developing sleeve) that carries a developer to develop an electrostatic latent image formed on an image bearing member, and a regulating blade serving as a developer regulating member that regulates the amount of the developer carried on the developer bearing member. The regulating blade is opposed to the developer bearing member across a predetermined gap (hereinafter, referred to as a sleeve-blade (SB) gap) from the developer bearing member over an entire area in a rotation axis direction of the developer bearing member. The SB gap refers to a minimum distance between the developer bearing member and the regulating blade. The amount of the developer fed to a developing region where the developer bearing member is opposed to the image bearing member is adjusted by adjusting the size of the SB gap.

A developing device including a resin-made developer regulating member molded of resin and a resin-made developing device frame molded of resin has been known in recent years (see Japanese Patent Application Laid-Open No. 2014-197175).

The developing device including the resin-made regulating blade and the resin-made developing device frame can be configured such that the resin-made regulating blade is mounted on and fixed to a blade mounting portion of the resin-made developing device frame.

As the width of a sheet on which an image is formed increases, the longitudinal length of a region of the regulating blade corresponding to a maximum image region among image regions formable on the image bearing member (maximum image region of the regulating blade) increases. As the longitudinal length of the maximum image region of the regulating blade increases, the longitudinal length of a surface on which the regulating blade is mounted (hereinafter, referred to as a blade mounting surface) of the blade mounting portion of the developing device frame increases.

If a developing device frame having a blade mounting surface that is long in the longitudinal direction is molded of resin, the blade mounting surface of the developing device frame is likely to increase in unevenness, and the flatness (Japanese Industrial Standards (JIS) B 0021) of the blade mounting surface of the developing device frame tends to increase. The reason is that, typically, the greater the longitudinal length of a resin molded article, the more easily flatness variations occur longitudinally over the resin molded article. The greater the flatness of the blade mounting surface of the developing device frame, the greater the amount of variation in the relative positon of the regulating blade to the developing sleeve, including the position where the regulating blade is closest to the developing sleeve, tends to be when the regulating blade is mounted on the blade mounting surface.

The greater the amount of variation in the relative position of the regulating blade to the developing sleeve when the regulating blade is mounted on the blade mounting surface, the more likely the size of the SB gap in a state the regulating blade is fixed to the blade mounting surface is to vary longitudinally over the developing sleeve. Variations in the size of the SB gap longitudinally over the developing sleeve can make uneven the amount of the developer carried on the surface of the developing sleeve longitudinally over the developing sleeve.

In the configuration where the resin-made regulating blade is fixed to the blade mounting portion of the resin-made developing device frame, an SB gap falling within a predetermined range longitudinally over the developing sleeve regardless of the flatness of the blade mounting surface may be desirable. For this purpose, the following configuration is desirable. It is a configuration that prevents a value of the SB gap measured by a camera or a transmission sensor from departing from the actual value of the SB gap when the relative position of the regulating blade to the developing sleeve varies due to the flatness of the blade mounting surface of the developing device frame.

SUMMARY OF THE DISCLOSURE

The present disclosure is directed to preventing a measured value of a "gap between a rotatable developing member and a regulating blade" from departing from the actual value of the "gap between the rotatable developing member and the regulating blade" even if a relative position of the resin-made regulating blade to the rotatable developing member varies due to "flatness of a blade mounting surface" of the resin-made developing device frame.

According to an aspect of the present disclosure, a developing device includes a rotatable developing member configured to carry and feed a developer including toner and a carrier toward a position where an electrostatic image formed on an image bearing member is developed, a resin-made regulating blade opposed to the rotatable developing member and configured to regulate an amount of the developer carried on the rotatable developing member, and a resin-made developing device frame configured separately from the regulating blade. The developing device frame includes a mounting portion on which the regulating blade is mounted. When the developing device is seen in a cross section orthogonal to a rotation axis of the rotatable developing member, the regulating blade has a cutout across an entirety of a region from a first position where the regulating blade is closest to the rotatable developing member to a second position 0.5 mm downstream of the regulating blade from the first position in a rotation direction of the rotatable developing member. A cut amount of the cutout at the second position is 0.3 mm or more.

Further features and aspects of the present disclosure will become apparent from the following description of example embodiments with reference to the attached drawings.

DESCRIPTION OF THE EMBODIMENTS

Example embodiments, features and aspects of the present disclosure will be described in detail below with reference to the accompanying drawings. The following example embodiments are not intended to limit the present disclosure set forth in the claims. All combinations of features described in a first example embodiment are not necessarily indispensable to the solving means of the present disclosure. Example embodiments of the present disclosure are applicable to various applications including a printer, various printing machines, a copying machine, a facsimile (FAX), and a multifunction peripheral.

(Configuration of Example Image Forming Apparatus)

Figure 1:
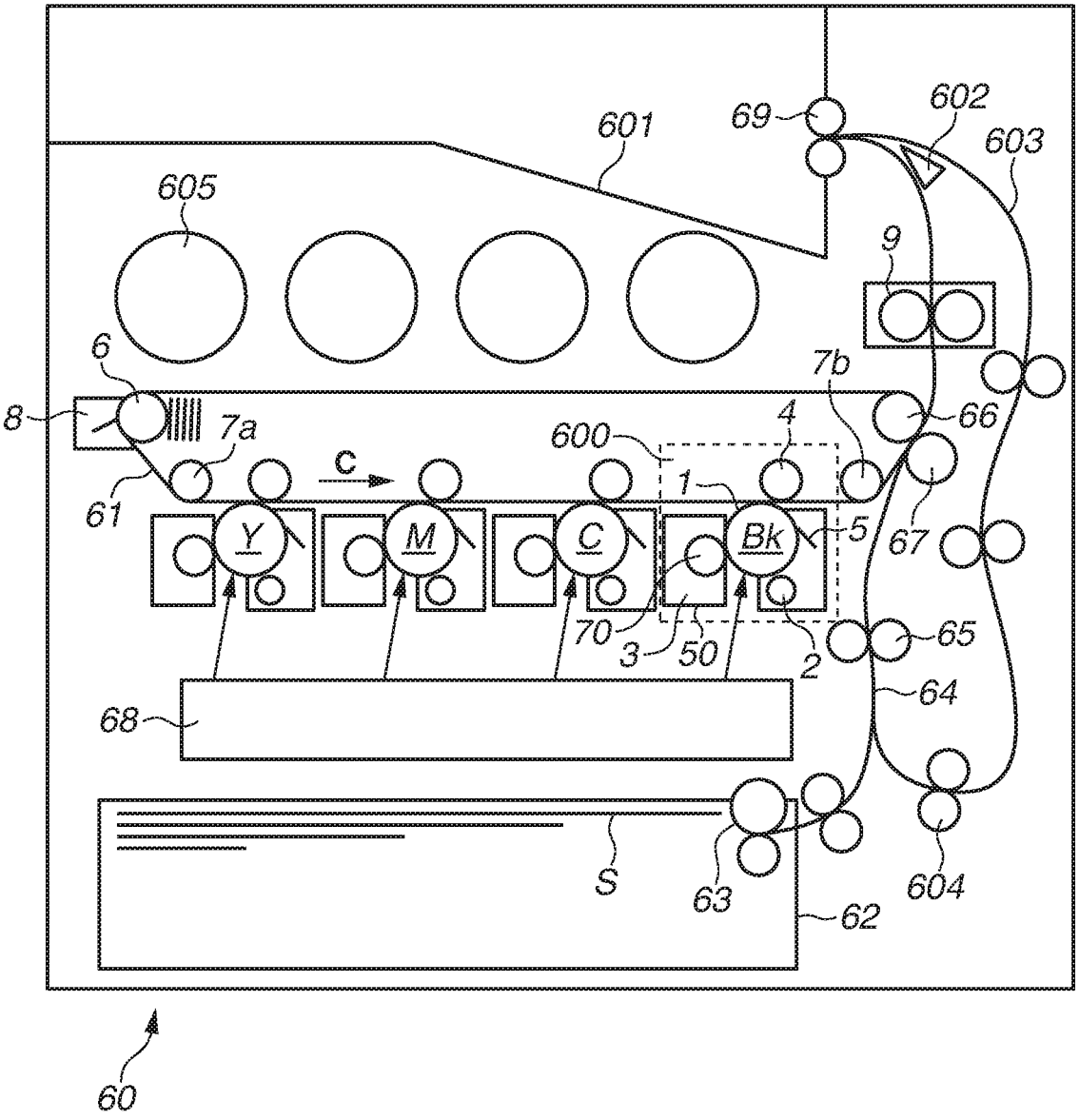
FIG. 1 is a sectional view illustrating a configuration of an example image forming apparatus.

A configuration of an image forming apparatus according to the first example embodiment of the present disclosure will initially be described with reference to the sectional view of FIG. 1. As illustrated in FIG. 1, an image forming apparatus 60 includes an endless intermediate transfer belt (ITB) 61 serving as an intermediate transfer member, and four image forming units 600 arranged from upstream to downstream along a rotation direction of the ITB 61 (the direction of the arrow C in FIG. 1). The image forming units 600 generate respective toner images of yellow (Y), magenta (M), cyan (C), and black (Bk) colors.

The image forming units 600 each include a rotatable photosensitive drum 1 serving as an image bearing member. Each image forming unit 600 further includes a charging roller 2 serving as a charging unit, a developing device 3 serving as a developing unit, a primary transfer roller 4 serving as a primary transfer unit, and a photosensitive member cleaner 5 serving as a photosensitive member cleaning unit. The charging roller 2, the developing device 3, the primary transfer roller 4, and the photosensitive member cleaner 5 are arranged along a rotation direction of the photosensitive drum 1.

The developing devices 3 each can be detachably attached to the image forming apparatus 60. Each developing device 3 includes a developing container 50 that contains a two-component developer (hereinafter, referred to simply as a developer) including a nonmagnetic toner (hereinafter, referred to simply as a toner) and a magnetic carrier. Toner cartridges containing respective toners of Y, M, C, and Bk colors can be detachably attached to the image forming apparatus 60. The Y, M, C, and Bk color toners are supplied to the respective developing containers 50 through toner conveyance paths. Details of the developing devices 3 will be described below with reference to FIGS. 2 to 4. Details of the developing containers 50 will be described below with reference to FIG. 5.

The ITB 61 is stretched by a tension roller 6, a driven roller 7*a*, the primary transfer rollers 4, a driven roller 7*b*, and a secondary transfer inner roller 66, and driven for conveyance in the direction of the arrow C in FIG. 1. The secondary transfer inner roller 66 also serves as a driving roller that drives the ITB 61. Rotation of the secondary transfer inner roller 66 rotates the ITB 61 in the direction of the arrow C in FIG. 1.

The ITB 61 is pressed by the primary transfer rollers 4 from the back side of the ITB 61. The ITB 61 is brought into contact with the photosensitive drums 1, whereby primary transfer nip portions serving as primary transfer portions are formed between the photosensitive drums 1 and the ITB 61.

An intermediate transfer member cleaner 8 serving as a belt cleaning unit is opposed to the tension roller 6 via the ITB 61 and put in contact with the ITB 61. A secondary transfer outer roller 67 serving as a secondary transfer unit is opposed to the secondary transfer inner roller 66 via the ITB 61. The ITB 61 is sandwiched between the secondary transfer inner roller 66 and the secondary transfer outer roller 67. A secondary transfer nip portion serving as a secondary transfer portion is thereby formed between the secondary transfer outer roller 67 and the ITB 61. In the secondary transfer nip portion, a predetermined pressure and a predetermined transfer bias (electrostatic load bias) are applied so that a toner image is attracted to the surface of a sheet S (such as a sheet of paper or a film).

Sheets S are stacked and stored in a sheet storage unit 62 (such as a feed cassette and a feed deck). A feeding unit 63 feeds a sheet S in synchronization with image formation timing, for example, by a frictional separation method using a feed roller. The sheet S fed out by the feeding unit 63 is conveyed to a registration roller 65 on a conveyance path 64. After a skew correction and a timing correction by the registration roller 65, the sheet S is conveyed to the secondary transfer nip portion. In the secondary transfer nip portion, a secondary transfer is performed with the sheet S and the toner image matched in timing.

A fixing device 9 is arranged downstream of the secondary transfer nip portion in the conveyance direction of the sheet S. The fixing device 9 applies a predetermined pressure and a predetermined amount of heat to the sheet S conveyed to the fixing device 9, whereby the toner image on the surface of the sheet S is melted and fixed. The image-fixed sheet S is then discharged to a discharge tray 601 by forward rotation of a discharge roller 69.

In the case of two-sided image formation, the sheet S is conveyed by the forward rotation of the discharge roller 69 until the trailing edge of the sheet S passes a diverter 602. The discharge roller 69 is then reversely rotated. The sheet S is thereby conveyed to a two-sided conveyance path 603 with the leading and trailing edges reversed. The sheet S is then conveyed to the conveyance path 64 again by a refeeding roller 604 in synchronization with the next image formation timing.

(Example Image Formation Process)

During image formation, each photosensitive drum 1 is driven to rotate by a motor. The charging roller 2 uniformly pre-charges the surface of the photosensitive drum 1 driven to rotate. An exposure device 68 forms an electrostatic latent image on the surface of the photosensitive drum 1 charged by the charging roller 2 based on an image information signal input to the image forming apparatus 60. A plurality of sizes of electrostatic latent images can be formed on the photosensitive drum 1.

The developing device 3 includes a rotatable developing sleeve 70 serving as a developer bearing member that carries the developer. The developing device 3 develops the electrostatic latent image formed on the surface of the photosensitive drum 1 by using the developer carried on the surface of the developing sleeve 70. As a result, the toner adheres to and visualizes exposed portions on the surface of the photosensitive drum 1. A transfer bias (electrostatic load bias) is applied to the primary transfer roller 4, and the toner image formed on the surface of the photosensitive drum 1 is transferred onto the ITB 61. A small amount of toner (transfer residual toner) remaining on the surface of the photosensitive drum 1 after the primary transfer is collected by the photosensitive member cleaner 5 and made ready again for the next image forming process.

The image forming units 600 of Y, M, C, and Bk colors perform the image forming processes of the respective colors in parallel in such timing that toner images are sequentially superposed on those of upstream colors primarily transferred onto the ITB 61. This forms a full-color toner image on the ITB 61, and the toner image is conveyed to the secondary transfer nip portion. A transfer bias is applied to the secondary transfer outer roller 67, and the toner image formed on the ITB 61 is transferred to the sheet S conveyed to the secondary transfer nip portion. A small amount of toner (transfer residual toner) remaining on the ITB 61 after the passing of the sheet S through the secondary transfer nip portion is collected by the intermediate transfer member cleaner 8. The fixing device 9 fixes the toner image transferred onto the sheet S. The sheet S on which the fixing processing is performed by the fixing device 9 is discharged to the discharge tray 601.

When a series of image forming processes described above ends, the image forming apparatus 60 gets ready for the next image forming operation.

(Example Configuration of Developing Device)

Figure 2:
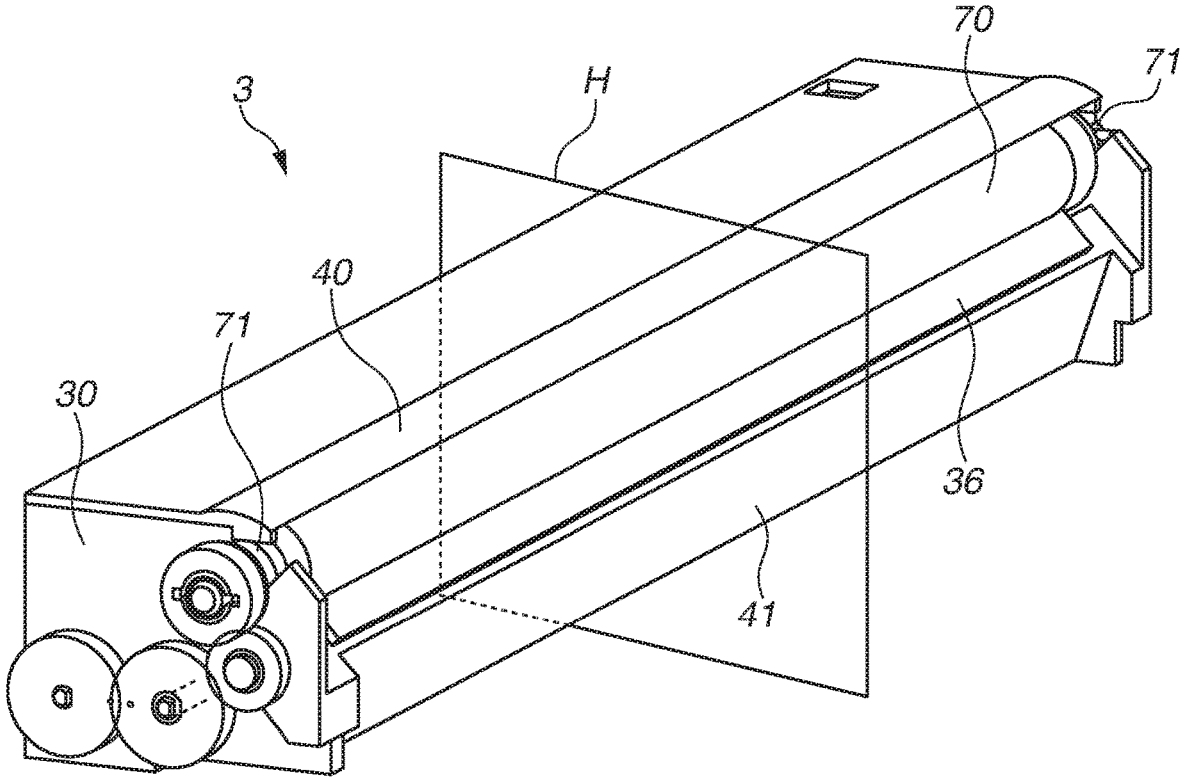
FIG. 2 is a perspective view illustrating a configuration of an example developing device.
Figure 3:
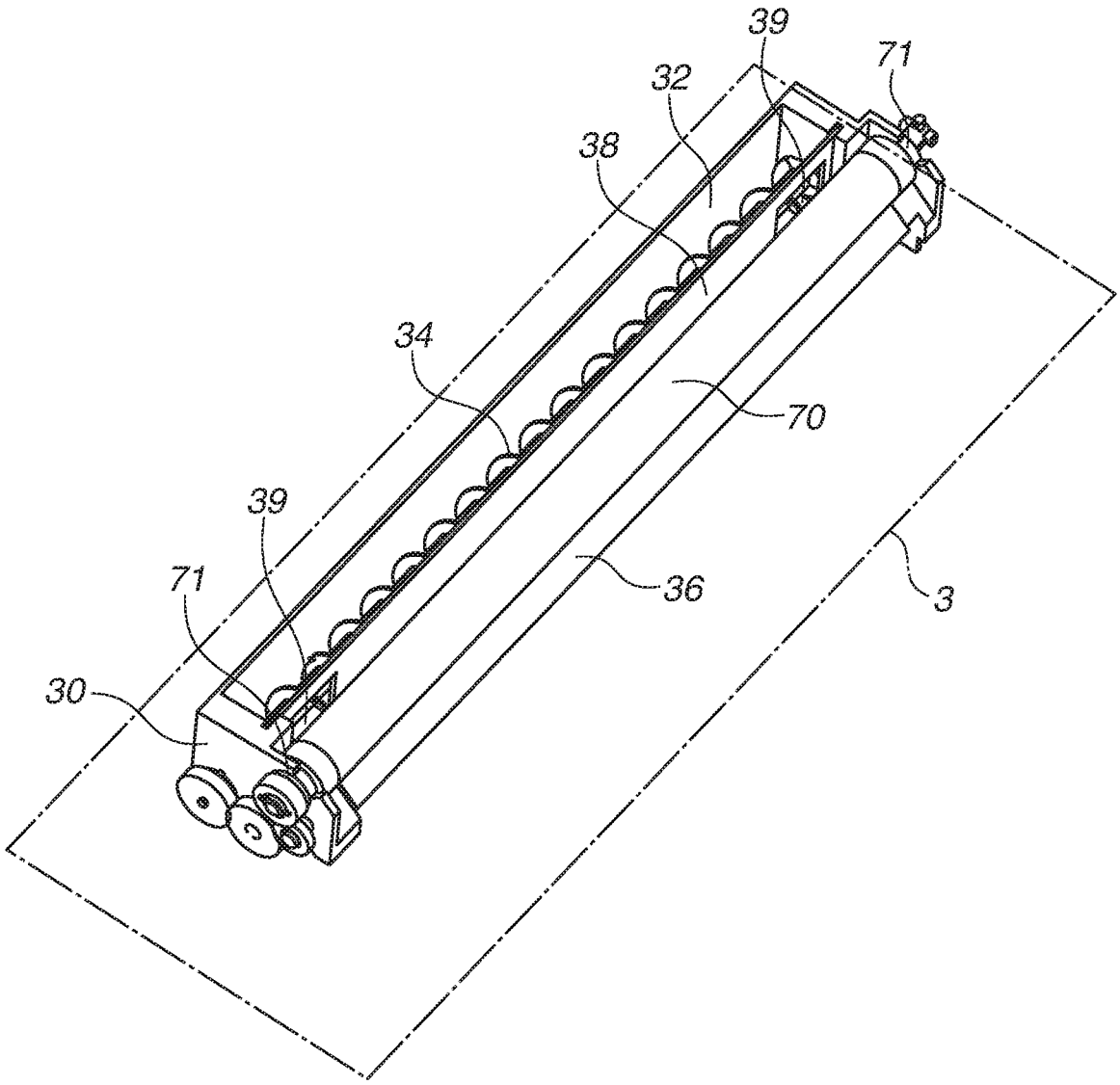
FIG. 3 is a perspective view illustrating the configuration of the developing device.
Figure 4:
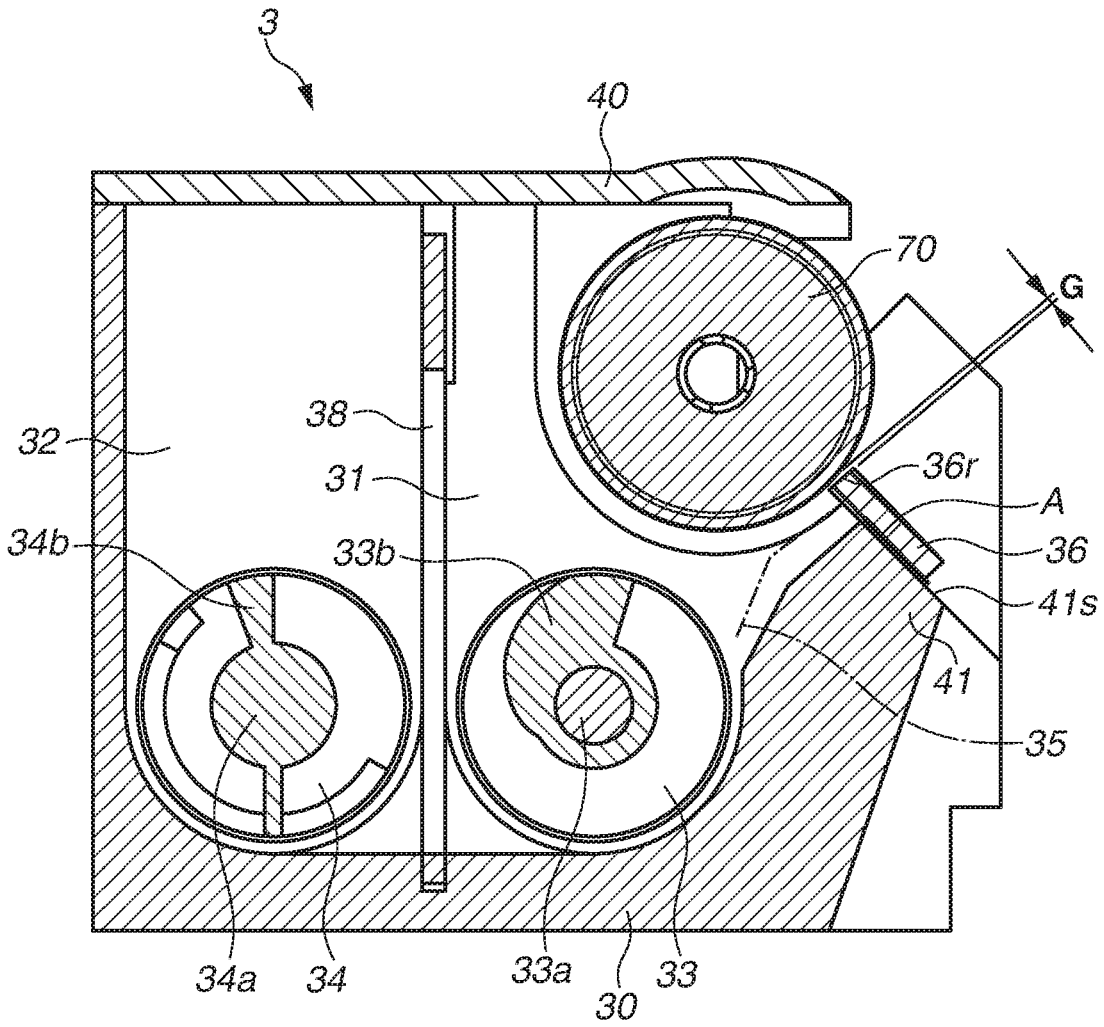
FIG. 4 is a sectional view illustrating the configuration of the developing device.

A typical configuration of the developing device 3 will be described with reference to the perspective view of FIG. 2, the perspective view of FIG. 3, and the sectional view of FIG. 4. FIG. 4 is a sectional view of the developing device 3 seen in section H in FIG. 2.

The developing device 3 includes a developing container 50 that includes a resin-made developing device frame (hereinafter, referred to simply as a developing device frame 30) molded of resin and a resin-made cover frame (hereinafter, referred to simply as a cover frame 40) molded of resin. The cover frame 40 is formed separately from the developing device frame 30. FIGS. 2 and 4 illustrate a state where the cover frame 40 is attached to the developing device frame 30. FIG. 3 illustrates a state where the cover frame 40 is not attached to the developing device frame 30. Details of the configuration of the developing device frame 30 (by itself) will be described below with reference to FIG. 6.

The developing container 50 has an opening at a position corresponding to a developing region where the developing sleeve 70 is opposed to the photosensitive drum 1. The developing sleeve 70 is rotatably arranged in the developing container 50 such that part of the developing sleeve 70 is exposed from the opening of the developing container 50. Bearings 71 that are bearing members are provided on both ends of the developing sleeve 70.

The interior of the developing container 50 is sectioned (divided) into a developing chamber 31 serving as a first chamber and an agitation chamber 32 serving as a second chamber by a vertically extending partition 38. The developing chamber 31 and the agitation chamber 32 communicate at both longitudinal ends through two communication portions 39 of the partition 38. The developer can circulate through the developing chamber 31 and the agitation chamber 32 via the communication portions 39. The developing chamber 31 and the agitation chamber 32 are horizontally arranged next to each other.

A magnet roll including a plurality of magnetic poles along the rotation direction of the developing sleeve 70 is fixedly arranged inside the developing sleeve 70. The magnet roll serves as a magnetic field generation unit that generates a magnetic field for carrying the developer on the surface of the developing sleeve 70. The developer in the developing chamber 31 is taken up by the effect of the magnetic field generated by the magnetic poles of the magnet roll, and supplied to the developing sleeve 70. Since the developer is supplied from the developing chamber 31 to the developing sleeve 70 in such a manner, the developing chamber 31 is also referred to as a supply chamber.

A first conveyance screw 33 serving as a conveyance unit that agitates and conveys the developer in the developing chamber 31 is opposed to the developing sleeve 70 in the developing chamber 31. The first conveyance screw 33 includes a rotation shaft 33*a* serving as a rotatable shaft portion, and a helical blade portion 33*b* serving as a developer conveyance portion along the outer periphery of the rotation shaft 33*a*. The first conveyance screw 33 is rotatably supported in the developing container 50. Bearing members are provided at both ends of the rotation shaft 33*a*.

A second conveyance screw 34 serving as a conveyance unit that agitates the developer in the agitation chamber 32 and conveys the developer in a direction opposite from that of the first conveyance screw 33 is arranged in the agitation chamber 32. The second conveyance screw 34 includes a rotation shaft 34*a* serving as a rotatable shaft portion, and a helical blade portion 34*b* serving as a developer conveyance portion along the outer periphery of the rotation shaft 34*a*. The second conveyance screw 34 is rotatably supported in the developing container 50. Bearing members are provided at both ends of the rotation shaft 34*a*. Driving the first and second conveyance screws 33 and 34 to rotate forms a circulation path through which the developer circulates between the developing chamber 31 and the agitation chamber 32 via the communication portions 39.

A regulating blade (hereinafter, referred to as a doctor blade 36) serving as a developer regulating member that regulates the amount of the developer carried on the surface of the developing sleeve 70 (also referred to as a developer coating amount) is attached to the developing container 50. The doctor blade 36 is opposed to the surface of the developing sleeve 70 in a contactless manner. The doctor blade 36 has a coating amount regulating surface 36*r* serving as a regulating portion that regulates the amount of the developer carried on the surface of the developing sleeve 70. The doctor blade 36 is a resin-made doctor blade molded of resin. The configuration of the doctor blade 36 (by itself) will be described below with reference to FIG. 5.

The doctor blade 36 is opposed to the developing sleeve 70 across a predetermined gap (hereinafter, referred to as a sleeve-blade (SB) gap G) from the developing sleeve 70 longitudinally over the developing sleeve 70 (along a rotation axis direction of the developing sleeve 70). In the present example embodiment, the SB gap G refers to a minimum distance between a maximum image region of the developing sleeve 70 and a maximum image region of the doctor blade 36. The maximum image region of the developing sleeve 70 refers to a region of the developing sleeve 70 corresponding to a maximum image region, in terms of the rotation axis direction of the developing sleeve 70, among image regions where an image is formable on the surface of the photosensitive drum 1. The maximum image region of the doctor blade 36 is a region of the doctor blade 36 corresponding to the maximum image region, in terms of the rotation axis direction of the developing sleeve 70, among the image regions where an image is formable on the surface of the photosensitive drum 1. In the first example embodiment, a plurality of sizes of electrostatic latent images can be formed on the photosensitive drum 1. The maximum image region refers to the image region corresponding to the maximum size (for example, A3 size) among the plurality of sizes of the image regions formable on the photosensitive drum 1. In a modification where only one size of electrostatic latent image is formable on the photosensitive drum 1, the maximum image region may be rephrased as the image region of the one size where an image is formable on the photosensitive drum 1.

The doctor blade 36 is substantially opposed to a position where a magnetic flux density from a predetermined magnetic pole (regulation pole) of the magnet roll peaks. The developer supplied to the developing sleeve 70 is affected by the magnetic field generated by the magnetic poles of the magnet roll. The developer regulated and scraped off by the doctor blade 36 tends to reside upstream of the SB gap G. This forms a developer bank on the upstream side of the doctor blade 36 in the rotation direction of the developing sleeve 70. As the developing sleeve 70 rotates, part of the developer in the developer bank is conveyed to pass through the SB gap G. The thickness of the developer passing through the SB gap G here is regulated by the coating amount regulating surface 36*r* of the doctor blade 36. In such a manner, a thin layer of the developer is formed on the surface of the developing sleeve 70.

A predetermined amount of developer carried on the surface of the developing sleeve 70 is fed to the developing region by the rotation of the developing sleeve 70. The amount of the developer fed to the developing region is thus adjusted by adjusting the size of the SB gap G. In the first example embodiment, the target size of the SB gap G (target value of the SB gap G) in adjusting the size of the SB gap G is set to approximately 300 μm.

The developer fed to the developing region is magnetically napped to form a magnetic brush in the developing region. The magnetic brush makes contact with the photosensitive drum 1, whereby the toner in the developer is supplied to the photosensitive drum 1. The electrostatic latent image formed on the surface of the photosensitive drum 1 is thereby developed into a toner image. The developer on the surface of the developing sleeve 70 after the passing through the developing region and the supply of the toner to the photosensitive drum 1 (hereinafter referred to as developer after the developing step) is stripped off from the surface of the developing sleeve 70 by a repulsive magnetic field formed between magnetic poles of the same polarity in the magnet roll. The developer after the developing step, stripped off from the surface of the developing sleeve 70, falls into and is collected in the developing chamber 31.

As illustrated in FIG. 4, the developing device frame 30 includes a developer guide portion 35 for guiding the developer so that the developer is fed toward the SB gap G. The developer guide portion 35 and the developing device frame 30 are integrally formed. The developer guide portion 35 and the doctor blade 36 are configured as separate members. The developer guide portion 35 is formed inside the developer device frame 30 and located upstream of the coating amount regulating surface 36*r* of the doctor blade 36 in the rotation direction of the developing sleeve 70. The developer guide portion 35 stabilizes and straightens the flow of the developer into a predetermined developer density, whereby the weight of the developer at a position where the coating amount regulating surface 36*r* of the doctor blade 36 is closest to the surface of the developing sleeve 70 can be determined.

As illustrated in FIG. 4, the cover frame 40 is formed separately from the developing device frame 30 and attached to the developing device frame 30. The cover frame 40 covers part of the opening in the developing device frame 30 such that part of the outer peripheral surface of the developing sleeve 70 is covered over the entirety of the developing sleeve 70 in the longitudinal direction. The cover frame 40 here covers part of the opening in the developing device frame 30 such that the developing region of the developing sleeve 70 opposed to the photosensitive drum 1 is exposed. The cover frame 40 is fixed to the developing device frame 30 by ultrasonic bonding. However, the cover frame 40 may be fixed to the developing device frame 30 by any of the following methods: screw fastening, snap fitting, adhesion, and welding. The cover frame 40 may be composed of a single part (resin molded article) as illustrated in FIG. 4. The cover frame 40 may be composed of a plurality of parts (resin molded articles).

(Configuration of Example Resin-Made Doctor Blade)

A configuration of the doctor blade 36 (by itself) will be described with reference to the perspective view of FIG. 5.

During an image forming operation (developing operation), the doctor blade 36 undergoes a pressure from the developer (hereinafter, referred to as a developer pressure) caused by the flow of the developer. The lower the rigidity of the doctor blade 36, the more likely the doctor blade 36 is to deform and the more easily the size of the SB gap G tends to vary when a developer pressure is applied to the doctor blade 36 during the image forming operation. In the image forming operation, the developer pressure applies in the widthwise direction of the doctor blade 36 (the direction of the arrow M in FIG. 5). To suppress variations in the size of the SB gap G during the image forming operation, the widthwise rigidity of the doctor blade 36 is desirably increased to strengthen the doctor blade 36 against a widthwise deformation.

Figure 5:
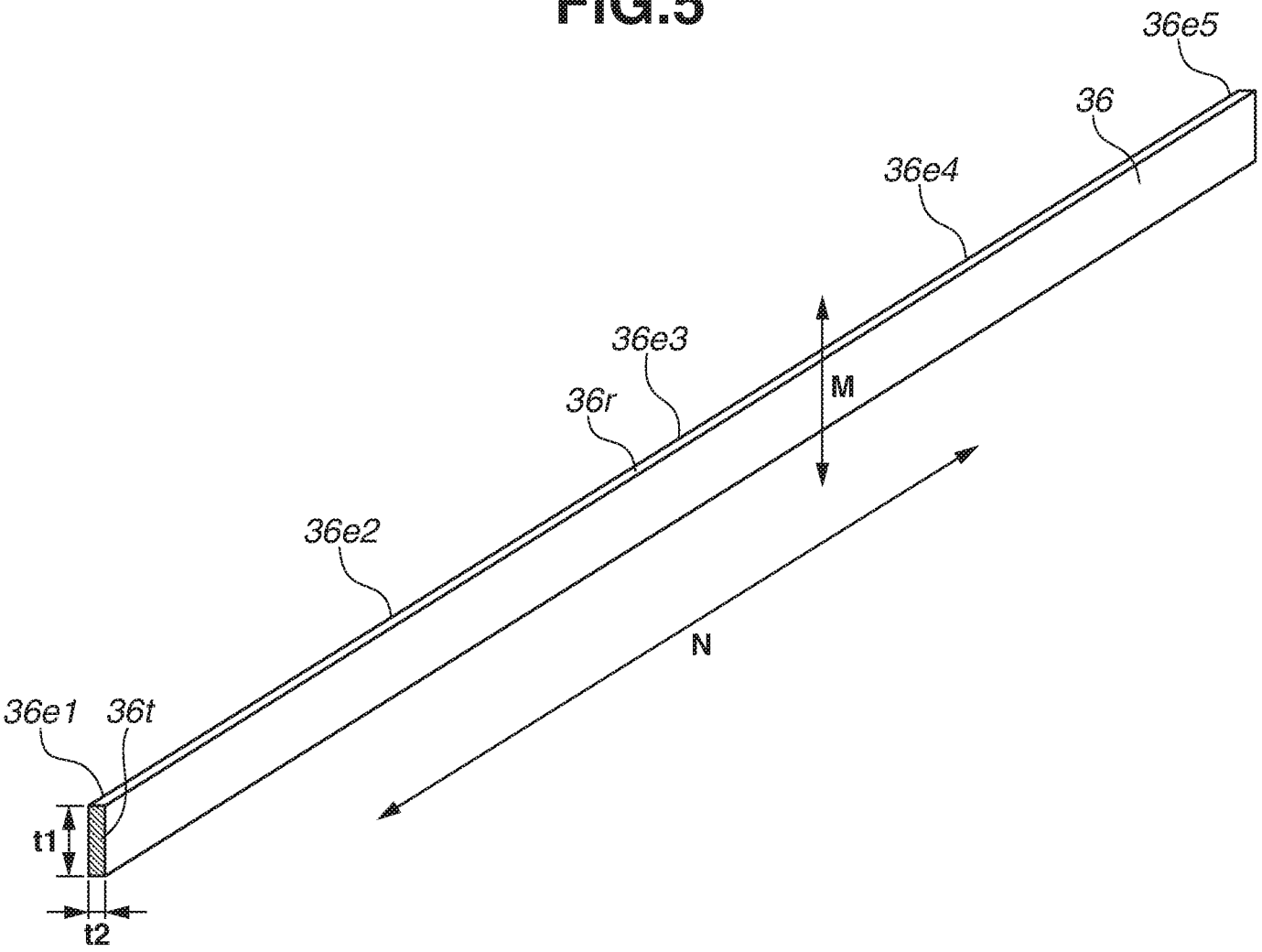
FIG. 5 is a perspective view illustrating a configuration of an example resin-made doctor blade (by itself).

As illustrated in FIG. 5, the doctor blade 36 is formed in a plate-like shape in view of mass productivity and cost. As illustrated in FIG. 5, a side surface 36*t* of the doctor blade 36 has a small sectional area. A length t2 of the doctor blade 36 in the thickness direction is smaller than a length t1 of the doctor blade 36 in the widthwise direction. The doctor blade 36 (by itself) is thus configured to easily deform in a direction (the direction of the arrow M in FIG. 5) orthogonal to the longitudinal direction of the doctor blade 36 (the direction of the arrow N in FIG. 5). To correct the straightness of the coating amount regulating surface 36*r*, the doctor blade 36 is fixed to a blade mounting portion 41 of the developing device frame 30 in a state that at least part of the doctor blade 36 is flexed in the direction of the arrow M in FIG. 5. Details of the straightness correction on the doctor blade 36 will be described below with reference to FIG. 9.

(Configuration of Example Resin-Made Developing Device Frame)

Figure 6:
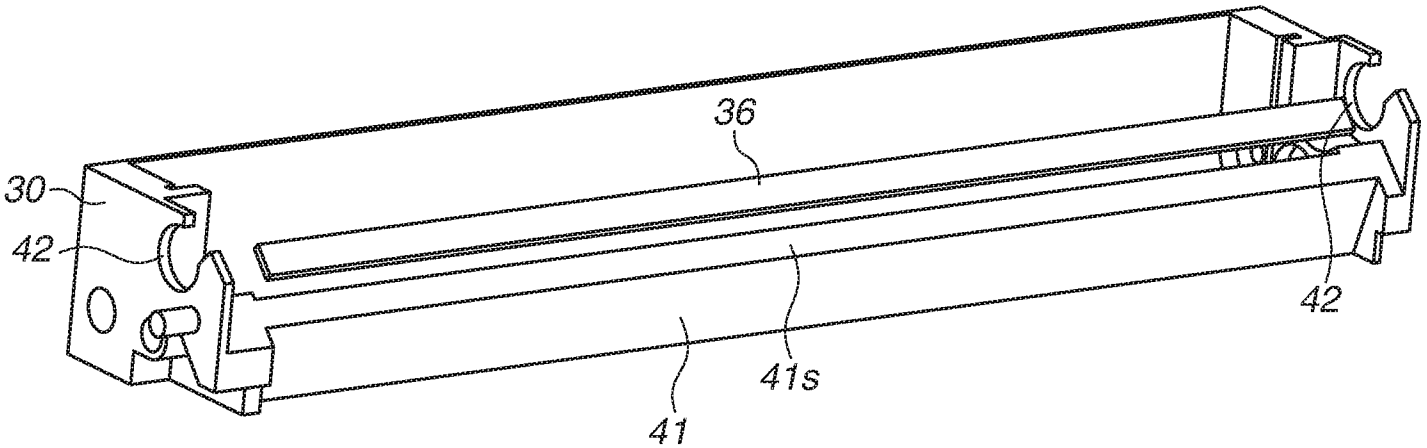
FIG. 6 is a perspective view illustrating a configuration of a resin-made developing device frame (by itself).

A configuration of the developing device frame 30 (by itself) will be described with reference to the perspective view of FIG. 6. FIG. 6 illustrates the state where the cover frame 40 is not attached to the developing device frame 30.

The developing device frame 30 includes the developing chamber 31 and the agitation chamber 32 sectioned from the developing chamber 31 by the partition 38. The partition 38 is molded of resin. The partition 38 may be formed separately from the developing device frame 30 or integrally with the developing device frame 30.

The developing device frame 30 includes sleeve supporting portions 42 for rotatably supporting the developing sleeve 70 by supporting the bearings 71 arranged at the respective ends of the developing sleeve 70. The developing device frame 30 also includes the blade mounting portion 41 for mounting the doctor blade 36. The blade mounting portion 41 is formed integrally with the sleeve support portions 42. FIG. 6 illustrates a virtual state where the doctor blade 36 is lifted from the blade mounting portion 41.

The doctor blade 36 is fixed to the blade mounting portion 41 by curing an adhesive A applied to a blade mounting surface 41*s* of the blade mounting portion 41 with the doctor blade 36 mounted on the blade mounting portion 41.

(Rigidity of Resin-Made Doctor Blade)

The rigidity of the doctor blade 36 (by itself) will be described with reference to the schematic diagram of FIG. 7. The rigidity of the doctor blade 36 (by itself) is measured in a state where the doctor blade 36 is not fixed to the blade mounting portion 41 of the developing device frame 30.

Figure 7:
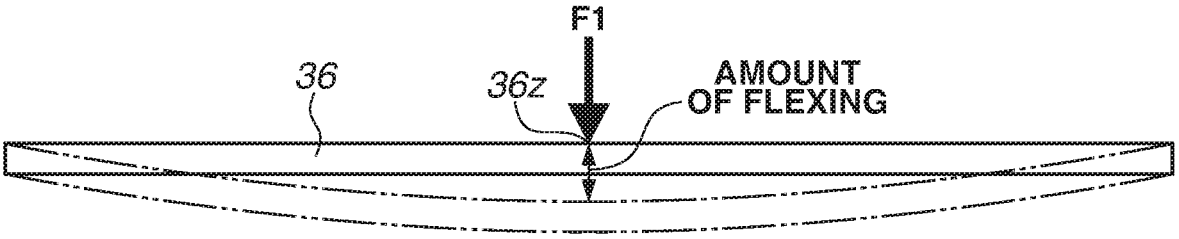
FIG. 7 is a schematic diagram for describing a rigidity of the resin-made doctor blade (by itself).

As illustrated in FIG. 7, a concentrated load F1 in the widthwise direction of the doctor blade 36 is applied to a longitudinal center portion 36*z* of the doctor blade 36. Here, the rigidity of the doctor blade 36 (by itself) is measured based on the amount of flexing in the widthwise direction of the doctor blade 36 at the center portion 36*z* of the doctor blade 36.

Suppose, for example, that a concentrated load F1 of 300 gf in the widthwise direction of the doctor blade 36 is applied to the longitudinal center portion 36*z* of the doctor blade 36. In such a case, the amount of flexing in the widthwise direction of the doctor blade 36 at the center portion 36*z* of the doctor blade 36 is 700 μm or more. The amount of sectional deformation at the center portion 36*z* of the doctor blade 36 is 5 μm or less.

(Rigidity of Resin-Made Developing Device Frame)

The rigidity of the developing device frame 30 (by itself) will be described with reference to the schematic diagram of FIG. 8. The rigidity of the developing device frame 30 (by itself) is measured in the state where the doctor blade 36 is not fixed to the blade mounting portion 41 of the developing device frame 30.

Figure 8:
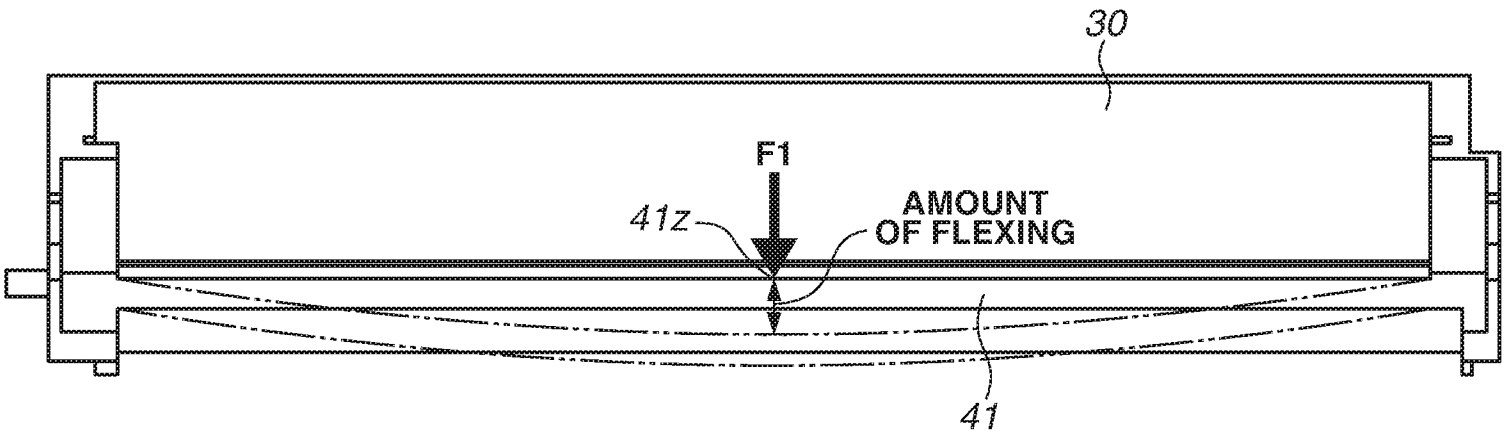
FIG. 8 is a schematic diagram for describing a rigidity of the resin-made developing device frame (by itself).

As illustrated in FIG. 8, a concentrated load F1 in the widthwise direction of the blade mounting portion 41 is applied to a longitudinal center portion 41*z* of the blade mounting portion 41. Here, the rigidity of the developing device frame 30 (by itself) is measured based on the amount of flexing in the widthwise direction of the blade mounting portion 41 at the center portion 41*z* of the blade mounting portion 41.

Suppose, for example, that a concentrated load F1 of 300 gf in the widthwise direction of the blade mounting portion 41 is applied to the longitudinal center portion 41*z* of the blade mounting portion 41. In such a case, the amount of flexing in the widthwise direction of the blade mounting portion 41 at the center portion 41*z* of the blade mounting portion 41 is 60 μm or less.

Suppose that the same amount of concentrated load F1 is applied to both the center portion 36*z* of the doctor blade 36 and the center portion 41*z* of the blade mounting portion 41 of the developing device frame 30. The amount of flexing at the center portion 36*z* of the doctor blade 36 here is 10 times or more that at the center portion 41*z* of the blade mounting portion 41. The developing device frame 30 (by itself) thus has a rigidity 10 times or even higher than that of the doctor blade 36 (by itself). In a state where the doctor blade 36 is mounted on and fixed to the blade mounting portion 41 of the developing device frame 30, the rigidity of the developing device frame 30 is dominant over that of the doctor blade 36. If the doctor blade 36 is fixed to the developing device frame 30 over the entirety of the maximum image region of the doctor blade 36, the rigidity of the doctor blade 36 fixed to the developing device frame 30 is higher than in a case where the doctor blade 36 is fixed only at both longitudinal ends.

The developing device frame 30 (by itself) has a rigidity higher than that of the cover frame 40 (by itself). In a state where the cover frame 40 is attached and fixed to the developing device frame 30, the rigidity of the developing device frame 30 is dominant over that of the cover frame 40.

(Straightness Correction on Resin-Made Doctor Blade)

As the width of the sheet S to form an image becomes large, like an A3-size width, the length of the maximum image region among image regions where an image is formable on the surface of the photosensitive drum 1 increases accordingly in the rotation axis direction of the developing sleeve 70. As the width of the sheet S to form an image increases, the length of the maximum image region of the doctor blade 36 therefore increases accordingly. If a doctor blade having a large longitudinal length is molded of resin, the straightness of the coating amount regulating surface of the resin-made doctor blade molded of resin is difficult to guarantee. The reason is that if a doctor blade that is long in the longitudinal length is molded of resin, the thermally-expanded resin is likely to thermally contract quickly in some areas and slowly in some areas depending on the longitudinal position on the doctor blade.

The greater the longitudinal length of the resin-made doctor blade, the more likely the SB gap G is to vary longitudinally over the developer bearing member due to the straightness of the coating amount regulating surface of the doctor blade. If the SB gap G varies longitudinally over the developer bearing member, the amount of the developer carried on the surface of the developing bearing member can be uneven longitudinally over the developer bearing member.

Suppose, for example, that a resin-made doctor blade having a longitudinal length corresponding to an A3 size (hereinafter, referred to as an A3 size capable resin-made doctor blade) is manufactured with the precision of ordinary resin molded articles. In such a case, the coating amount regulating surface has a straightness of around 300 to 500 μm. Even if an A3 size capable resin-made doctor blade is manufactured with high precision by using high precision resin materials, the straightness of the coating amount regulating surface is around 100 to 200 μm.

In the first example embodiment, the size of the SB gap G is set to approximately 300 μm, and the tolerance of the SB gap G (tolerance of the SB gap G with respect to the target value) is set to ±10% or less. That is, in the first example embodiment, the adjustable range of the SB gap G is 300±30 μm. This means that the maximum allowable tolerance of the SB gap G is 60 μm. An A3 size capable resin-made doctor blade, whether manufactured with the precision of ordinary resin molded articles or manufactured with high precision by using high precision resin materials, thus exceeds the allowable range of tolerance of the SB gap G even only with the precision of the straightness of the coating amount regulating surface.

A developing device including a resin-made doctor blade is desirably configured such that, in a state where the doctor blade is fixed to the mounting portion of the developing device frame, the SB gap G falls within a predetermined range over an entire area in the rotation axis direction of the developer bearing member regardless of the straightness of the coating amount regulating surface. In the first example embodiment, if a resin-made doctor blade having a coating amount regulating surface of low straightness is used, the straightness of the coating amount regulating surface is corrected. The SB gap G is thereby brought into the predetermined range over the entire area in the rotation axis direction of the developing sleeve 70 in the state where the doctor blade is fixed to the mounting portion of the developing device frame.

The straightness of the coating amount regulating surface 36*r* of the doctor blade 36 will be described with reference to the schematic diagram of FIG. 9. A straightness of the coating amount regulating surface 36*r* is expressed by the absolute value of a difference between maximum and minimum values of the outer shape of the coating amount regulating surface 36*r* with reference to a predetermined point of the coating amount regulating surface 36*r* in the longitudinal direction of the coating amount regulating surface 36*r*. Assume, for example, that the longitudinal center of the coating amount regulating surface 36*r* is the point of origin in an orthogonal coordinate system. A predetermined line passing through the point of origin is assumed as an X-axis, and a line drawn from the point of origin at right angles to the X-axis as a Y-axis. In such an orthogonal coordinate system, the straightness of the coating amount regulating surface 36*r* is expressed by the absolute value of a difference between the maximum and minimum values of the Y coordinate of the outer shape of the coating amount regulating surface 36*r*.

Figure 9:
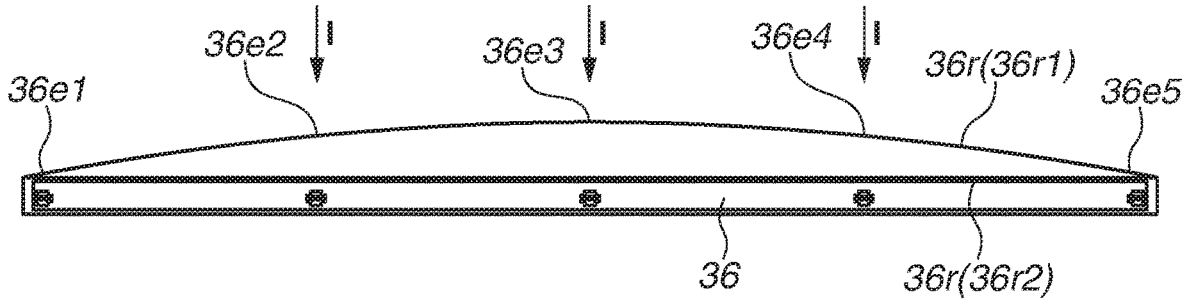
FIG. 9 is a schematic diagram for describing straightness of the resin-made doctor blade (by itself).

As illustrated in FIG. 9, the resin-made doctor blade 36 (by itself) is largely flexed in the midsection of the coating amount regulating surface 36*r* of the doctor blade 36 in the longitudinal direction of the doctor blade 36. The straightness of the doctor blade 36 therefore may desirably be corrected by reducing differences between the positions of edge portions 36*e* (36*e*1 to 36*e*5) of the doctor blade 36 illustrated in FIG. 5. The straightness of the coating amount regulating surface 36*r* of the doctor blade 36 may desirably be corrected to 50 μm or less in view of the allowable tolerance value of the SB gap G and the mounting precision of the doctor blade 36 on the developing device frame 30. Since a metal-made doctor blade formed by secondary machining has a precision of 20 μm or less in straightness, the straightness of the coating amount regulating surface 36*r* of the resin-made doctor blade 36 is more desirably corrected to 20 μm or less. In view of practical mass production steps, the setting value of the straightness correction on the coating amount regulating surface 36*r* of the doctor blade 36 is set to around 20 to 50 μm.

A force (also referred to as a straightness correction force) for flexing at least part of the maximum image region of the doctor blade 36 is applied to the doctor blade 36 to flex at least part of the maximum image region of the doctor blade 36. The straightness of the coating amount regulating surface 36*r* of the doctor blade 36 is thus corrected to 50 μm or less.

In the example of FIG. 9, the outer shapes at the edge portions 36*e*1 and 36*e*5 of the doctor blade 36 are assumed as a reference. Straightness correction forces are applied to the edge portions 36*e*2, 36*e*3, and 36*e*4 in the direction of the arrows 1 in FIG. 9 such that the outer shapes at the edge portions 36*e*2, 36*e*3, and 36*e*4 match the reference. As a result, the shape of the coating amount regulating surface 36*r* of the doctor blade 36 is corrected from that of a coating amount regulating surface 36*r*1 into that of a coating amount regulating surface 36*r*2, whereby the straightness of the coating amount regulating surface 36*r* of the doctor blade 36 can be corrected to 50 μm or less. While in the example of FIG. 9, the outer shapes at the edge portions 36*e*1 and 36*e*5 (both longitudinal ends of the coating amount regulating surface 36*r*) are used as the reference in matching the outer shapes of the doctor blade 36 at the edge portions 36*e*, the outer shape at the edge portion 36*e*3 (longitudinal center portion of the coating amount regulating surface 36*r*) may be used as the reference. In such a case, with the outer shape of the doctor blade 36 at the edge portion 36*c*3 as the reference, straightness correction forces are applied to the doctor blade 36 such that the outer shapes at the edge portions 36*e*1, 36*e*2, 36*c*4, and 36*c*5 match the reference.

To correct the straightness of the doctor blade 36 in such a manner, low rigidity of the doctor blade 36 (by itself) may be desirable such that at least part of the maximum image region of the coating amount regulating surface 36*r* is flexed if a straightness correction force is applied to the doctor blade 36.

(Example Method for Adjusting SB Gap)

The SB gap G is adjusted by moving the position of the doctor blade 36 with respect to the developing device frame 30 such that a relative position of the doctor blade 36 mounted on the blade mounting portion 41 to the developing sleeve 70 supported by the sleeve supporting portions 42 is adjusted. The doctor blade 36 of which at least part of the maximum image region is flexed is fixed to a predetermined position of the blade mounting portion 41 determined by adjusting the SB gap G, with an adhesive A applied in advance over the entirety of a maximum image region of the blade mounting surface 41*s*. The maximum image region of the blade mounting surface 41*s* refers to a region of the blade mounting surface 41*s* corresponding to the maximum image region, in terms of the rotation axis direction of the developing sleeve 70, among the image regions where an image is formable on the surface of the photosensitive drum 1. The region flexed to correct the straightness of the coating amount regulating surface 36*r* in the maximum image region of the doctor blade 36 is fixed to the blade mounting portion 41. The adhesive A does not need to be applied to part of the blade mounting surface 41*s* as long as the region undergoing the force for flexing at least part of the maximum image region of the doctor blade 36 is fixed to the blade mounting portion 41 with the adhesive A. That the adhesive A is applied over the entirety of the maximum image region of the blade mounting surface 41*s* refers to satisfying the following condition: That the adhesive A be applied to a region that includes the region flexed to correct the straightness of the coating amount regulating surface 36*r* within the region corresponding to the maximum image region of the doctor blade 36 and is greater than or equal to 95% the maximum image region of the blade mounting surface 41*s*.

This can prevent the region flexed to correct the straightness of the coating amount regulating surface 36*r* within the maximum image region of the doctor blade 36 from returning from the flexed state to the original unflexed state. The doctor blade 36 is thereby fixed to the blade mounting portion 41 with the straightness of the coating amount regulating surface 36*r* corrected to 50 μm or less.

A method for measuring (calculating) the size of the SB gap G will now be described. The size of the SB gap G is measured in a state where the developing sleeve 70 is supported by the sleeve supporting portions 42 of the developing device frame 30, the doctor blade 36 is mounted on the blade mounting portion 41 of the developing device frame 30, and the cover frame 40 is fixed to the developing device frame 30.

In measuring the size of the SB gap G, a light source (such as a light-emitting diode (LED) array and a light guide) is inserted into the developing chamber 31 longitudinally throughout the developing chamber 31. The light source inserted in the developing chamber 31 emits light from inside the developing chamber 31 toward the SB gap G. Cameras for capturing light beams emitted out of the developing device frame 30 through the SB gap G are located at five positions corresponding to the respective edge portions 36*e* (36*e*1 to 36*e*5) of the doctor blade 36.

The cameras located at the five positions capture the light beams emitted out of the developing device frame 30 through the SB gap G to measure the positions of the respective edge portions 36*e* (36*e*1 to 36*e*5) of the doctor blade 36. The cameras here capture a position on the surface of the developing sleeve 70 where the developing sleeve 70 is closet to the doctor blade 36 and the edge portions 36*e* (36*e*1 to 36*e*5) of the doctor blade 36. The pixel values of image data captured and generated by the cameras are then converted into distances to calculate the size of the SB gap G. If the calculated size of the SB gap G does not fall within a predetermined range, adjustments are made to the SB gap G. If the calculated size of the SB gap G falls within the predetermined range, this position is determined to be where the doctor blade 36 of which at least part of the maximum image region is flexed is fixed to the blade mounting portion 41 of the developing device frame 30.

Whether the SB gap G falls within the predetermined range over the entire area in the rotation axis direction of the developing sleeve 70 is determined by the following method. Initially, the maximum image region of the doctor blade 36 is equally divided into four or more parts. The SB gap G is measured at each of the dividing points of the doctor blade 36 (including both ends and the center of the maximum image region of the doctor blade 36), i.e., at five points or more. A maximum value, a minimum value, and a median of the SB gap G are extracted from the measurement value samples of the SB gap G measured at the five points or more.

The absolute value of a difference between the maximum value and the median of the SB gap G may desirably be less than or equal to 10% the median of the SB gap G, and the absolute value of a difference between the minimum value and the median of the SB gap G may desirably be less than or equal to 10% the median of the SB gap. In such a case, the tolerance of the SB gap G is ±10% or less, and the condition that the SB gap G falls within the predetermined range over the entire area in the rotation axis direction of the developing sleeve 70 is considered to be satisfied. For example, if the median of the SB gap G extracted from the measurement value samples of the SB gap G measured at five points or more is 300 μm, the maximum value of the SB gap G can be 330 μm or less, and the minimum value of the SB gap can be G 270 μm or more. In such a case, the adjustable range of the SB gap G is 300 μm±30 μm. A tolerance (tolerance of the SB gap G with respect to the target value) of up to 60 μm is allowable for the SB gap G.

(Linear Expansion Coefficient)

Next, a deformation of the doctor blade 36 and the developing device frame 30 because of a temperature change due to heat occurring during an image forming operation will be described with reference to the perspective view of FIG. 10. Examples of heat occurring during a developing operation include heat occurring during rotation of the rotation shaft of the developing sleeve 70 and the bearings 71, heat occurring during rotation of the rotation shaft 33*a* and bearing members of the first conveyance screw 33, and heat occurring when the developer passes through the SB gap G. The heat occurring during an image forming operation changes the temperature around the developing device 3, and changes the temperature of the doctor blade 36, the developing device frame 30, and the cover frame 40.

Figure 10:
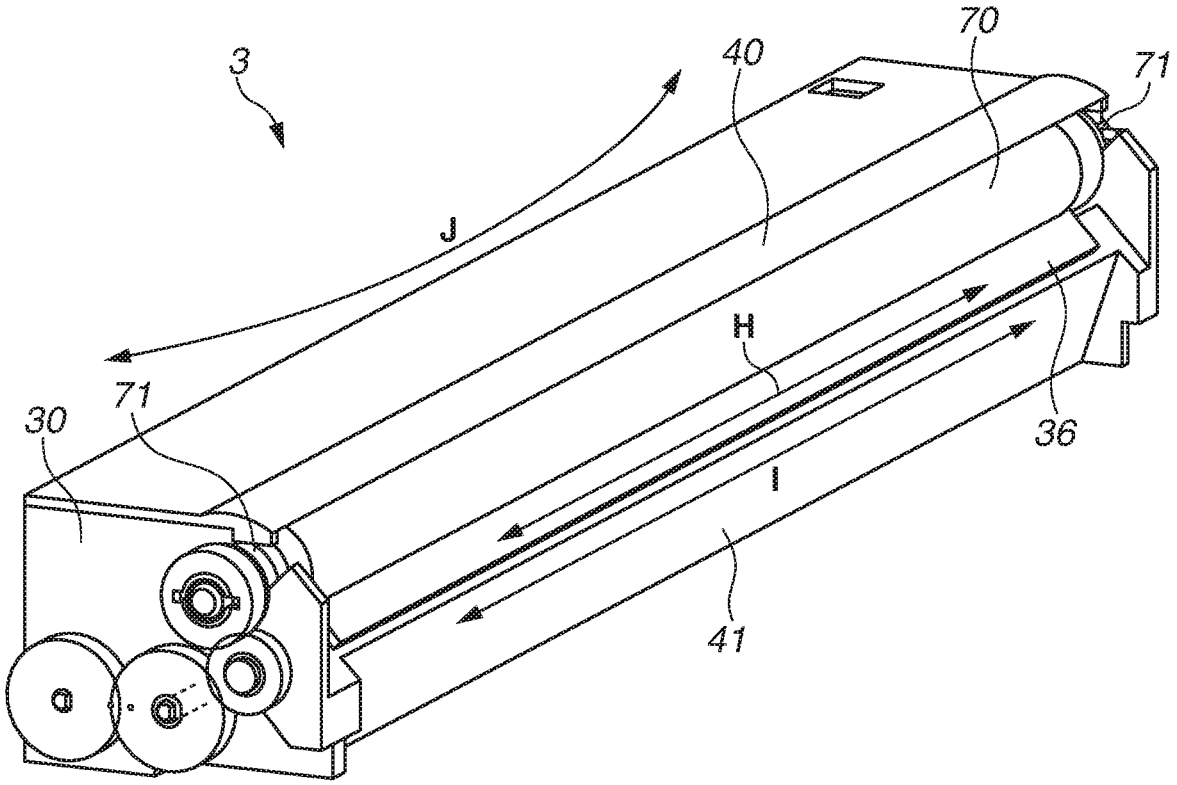
FIG. 10 is a perspective view for describing a deformation of the resin-made doctor blade due to a temperature change.

As illustrated in FIG. 10, the amount of extension of the doctor blade 36 due to a temperature change will be denoted by H [μm], and the amount of extension of the blade mounting surface 41*s* of the blade mounting portion 41 of the developing device frame 30 due to a temperature change will be denoted by 1 [μm]. Suppose that the resin constituting the doctor blade 36 has a linear expansion coefficient α1 different from a linear expansion coefficient α2 of the resin constituting the developing device frame 30. Since the linear expansion coefficients are different, the developing device frame 30 and the doctor blade 36 differ in the amount of deformation due to a temperature change. To compensate the difference between H [μm] and 1 [μm], the doctor blade 36 deforms in the direction of the arrow J in FIG. 10. The deformation of the doctor blade 36 in the direction of the arrow J in FIG. 10 will hereinafter be referred to as a deformation of the doctor blade 36 in a warping direction. The deformation of the doctor blade 36 in the warping direction leads to variations in the size of the SB gap G. Both the linear expansion coefficient α2 of the resin constituting the sleeve supporting portions 42 and the blade mounting portion 41 of the developing device frame 30 (by itself) and the linear expansion coefficient α1 of the resin constituting the doctor blade 36 (by itself) are involved in reducing variations in the size of the SB gap G due to heat. In other words, if the linear expansion coefficient α1 of the resin constituting the doctor blade 36 and the linear expansion coefficient α2 of the resin constituting the developing device frame 30 are different, the amounts of deformation due to a temperature change differ because of the difference between the linear expansion coefficients.

Resin materials typically have linear expansion coefficients higher than those of metal materials. If the doctor blade 36 is made of resin, the doctor blade 36 is likely to cause warpage and the longitudinal center portion of the doctor blade 36 is likely to cause a flexure as the temperature changes due to heat occurring during an image forming operation. In the developing device 3 in which the resin-made doctor blade 36 is fixed to the resin-made developing device frame 30, the size of the SB gap G is thus likely to change with a temperature change during an image forming operation.

To correct the straightness of the coating amount regulating surface 36*r* to 50 μm or less, at least part of the maximum image region of the doctor blade 36 is flexed. The doctor blade 36 of which at least part of the maximum image region is flexed is fixed to the blade mounting portion 41 of the developing device frame 30 over the entirety of the maximum image region of the doctor blade 36 with the adhesive A.

If there is a large difference between the thermal linear expansion coefficient $\alpha 2$ of the resin constituting the developing device frame 30 and the thermal linear expansion coefficient $\alpha 1$ of the resin constituting the doctor blade 36, the following issue arises when a temperature change occurs. That is, when a temperature change occurs, the amount of deformation (amount of expansion) of the doctor blade 36 due to the temperature change differs from the amount of deformation (amount of expansion) of the developing device frame 30 due to the temperature change. Consequently, a temperature change during an image forming operation results in variations in the size of the SB gap G even if the SB gap G is precisely adjusted in determining the mounting position of the doctor blade 36 on the blade mounting surface 41*s* of the developing device frame 30.

Since the doctor blade 36 is fixed to the blade mounting surface 41*s* over the entirety of the maximum image region, variations in the size of the SB gap G due to a temperature change during an image forming operation may desirably be reduced. To reduce unevenness in the amount of the developer carried on the surface of the developing sleeve 70 longitudinally over the developing sleeve 70, reducing the amount of variation of the SB gap G due to heat to ±20 μm or less may typically be desirable.

A difference of the linear expansion coefficient $\alpha 2$ of the resin constituting the developing device frame 30 including the sleeve supporting portions 42 and the blade mounting portion 41 from the linear expansion coefficient $\alpha 1$ of the resin constituting the doctor blade 36 will hereinafter be referred to as a linear expansion coefficient difference $\alpha 2-\alpha 1$. A change in the maximum amount of flexing of the doctor blade 36 depending on the linear expansion coefficient difference $\alpha 2-\alpha 1$ will be described with reference to Table 1. The maximum amount of flexing of the doctor blade 36 under a temperature change from a normal temperature (23° C.) to a high temperature (40° C.) was measured in a state that the doctor blade 36 was fixed to the blade mounting portion 41 of the developing device frame 30 over the entirety of the maximum image region of the doctor blade 36.

The linear expansion coefficient of the resin constituting the developing device frame 30 including the sleeve supporting portions 42 and the blade mounting portion 41 is denoted by $\alpha 2$ [m/° C.]. The linear expansion coefficient of the resin constituting the doctor blade 36 is denoted by $\alpha 1$ [m/° C.]. Table 1 illustrates the results obtained by measuring the maximum amount of flexing of the doctor blade 36 while changing the linear expansion coefficient difference $\alpha 2-\alpha 1$ as a parameter. In Table 1, the maximum amount of flexing of the doctor blade 36 is expressed by "OK" if the absolute value of the maximum value of flexing is 20 μm or less. The maximum amount of flexing of the doctor blade 36 is expressed by "NG" if the absolute value of the maximum value of flexing is greater than 20 μm.

TABLE 1

| | Linear expansion coefficient difference $\alpha 2-\alpha 1$ [$\times 10^{-5}$ m/° C.] | | | | | | | | |
|---|---|---|---|---|---|---|---|---|---|
| | 0 | +0.20 | +0.40 | +0.50 | +0.54 | +0.55 | +0.56 | +0.57 | +0.60 |
| Maximum amount of flexing of doctor blade | OK | OK | OK | OK | OK | OK | NG | NG | NG |
| | Linear expansion coefficient difference $\alpha 2-\alpha 1$ [$\times 10^{-5}$m/° C.] | | | | | | | | |
| | 0 | −0.20 | −0.40 | −0.44 | −0.45 | −0.46 | −0.47 | −0.50 | |
| Maximum amount of flexing of doctor blade | OK | OK | OK | OK | OK | NG | NG | NG | |

As can be seen from Table 1, to reduce the amount of variation of the SB gap G due to heat to ±20 μm or less, the linear expansion coefficient difference $\alpha 2-\alpha 1$ may desirably satisfy the following expression (Exp. 1):

$$-0.45\times 10^{-5}\ [\text{m/° C.}] \leq \alpha 2-\alpha 1 \leq 0.55\times 10^{-5}\ [\text{m/° C.}] \quad \text{(Exp. 1)}$$

The resin constituting the developing device frame 30 and the resin constituting the doctor blade 36 may therefore be selected such that the linear expansion coefficient difference $\alpha 2-\alpha 1$ becomes greater than or equal to $-0.45\times 10^{-5}$ [m/° C.] and less than or equal to $0.55\times 10^{-5}$ [m/° C.]. If the same resin is selected to constitute the developing device frame 30 and the doctor blade 36, the linear expansion coefficient difference $\alpha 2-\alpha 1$ is zero.

The application of the adhesive A to the doctor blade 36 and the developing device frame 30 changes the linear expansion coefficients of the doctor blade 36 and the developing device frame 30 where the adhesive A is applied. However, the volume of the adhesive A applied to the doctor blade 36 and the developing device frame 30 is extremely small, and the effect of changing dimensions in the thickness direction of the adhesive A under a temperature change is on a negligible level. A deformation of the doctor blade 36 in the warping direction due to a change of the linear expansion coefficient difference $\alpha 2-\alpha 1$ when the adhesive A is applied to the doctor blade 36 and the developing device frame 30 is thus on a negligible level.

Similarly, since the cover frame 40 is fixed to the developing device frame 30, a deformation of the cover frame 40 in the warping direction causes variations in the size of the SB gap G if the amounts of deformation of the developing device frame 30 and the cover frame 40 due to a temperature change are different. The linear expansion coefficient of the resin constituting the developing device frame 30 including the sleeve supporting portions 42 and the blade mounting portion 41 is denoted by $\alpha 2$ [m/° C.]. The linear expansion coefficient of the resin constituting the cover frame 40 is denoted by $\alpha 3$ [m/° C.]. A difference of the linear expansion coefficient $\alpha 3$ of the resin constituting the cover frame 40 from the linear expansion coefficient $\alpha 2$ of the resin constituting the developing device frame 30 including the sleeve supporting portions 42 and the blade mounting portion 41 will hereinafter be referred to as a linear expansion coefficient difference $\alpha 3-\alpha 2$. As in Table 1, the linear expansion coefficient difference $\alpha 3-\alpha 2$ may desirably satisfy the following expression (Exp. 2):

$$-0.45\times10^{-5}\ [\text{m/° C.}] \leq \alpha 3-\alpha 2 \leq 0.55\times10^{-5}\ [\text{m/° C.}] \quad \text{(Exp. 2)}$$

The resin constituting the developing device frame 30 and the resin constituting the cover frame 40 may therefore be selected such that the linear expansion coefficient difference $\alpha 3-\alpha 2$ becomes greater than or equal to $-0.45\times10^{-5}$ [m/° C.] and less than or equal to $0.55\times10^{-5}$ [m/° C.]. If the same resin is selected to constitute the developing device frame 30 and the cover frame 40, the linear expansion coefficient difference $\alpha 3-\alpha 2$ is zero.

(Developer Pressure)

Figure 11:
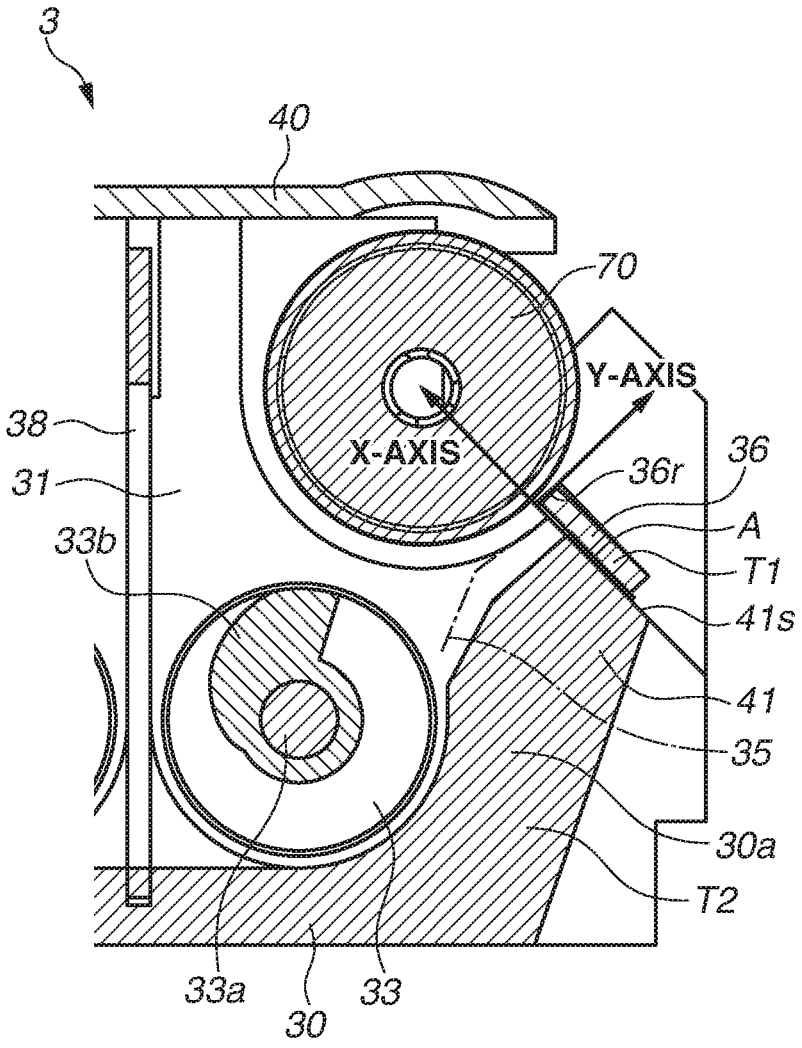
FIG. 11 is a sectional view for describing a deformation of the resin-made doctor blade due to a developer pressure.

Next, a deformation of the doctor blade 36 due to the application of a developer pressure caused by the flow of the developer to the doctor blade 36 during an image forming operation will be described with reference to the sectional view of FIG. 11. FIG. 11 is a sectional view of the developing device 3 seen in a cross section orthogonal to the rotation axis direction of the developing sleeve 70 (section H in FIG. 2). FIG. 11 illustrates a configuration near the doctor blade 36 fixed to the blade mounting portion 41 of the developing device frame 30 with the adhesive A.

As illustrated in FIG. 11, a line connecting the position on the coating amount regulating surface 36*r* where the doctor blade 36 is closest to the developing sleeve 70 and the rotation center of the developing sleeve 70 will be referred to as an X-axis. The doctor blade 36 is long in the X-axis direction, and the section has high rigidity in the X-axis direction. As illustrated in FIG. 11, the ratio of a sectional area T1 of the doctor blade 36 to a sectional area T2 of a wall portion 30*a* of the developing device frame 30 located near the developer guide portion 35 is small.

As described above, the developing device frame 30 (by itself) has rigidity 10 times or even higher than that of the doctor blade 36 (by itself). With the doctor blade 36 fixed to the blade mounting portion 41 of the developing device frame 30, the rigidity of the developing device frame 30 is dominant over that of the doctor blade 36. The amount of displacement (maximum amount of flexing) of the coating amount regulating surface 36*r* of the doctor blade 36 when the doctor blade 36 undergoes the developer pressure during an image forming operation is thus substantially equivalent to the amount of displacement (maximum amount of flexing) of the developing device frame 30.

During an image forming operation, the developer taken up from the first conveyance screw 33 passes over the developer guide portion 35 and is fed to the surface of the developing sleeve 70. When the layer thickness of the developer is regulated afterward to the size of the SB gap G by the doctor blade 36, the doctor blade 36 also undergoes developer pressure in various directions. As illustrated in FIG. 11, the direction orthogonal to the X-axis direction (direction for defining the SB gap G) will be referred to as a Y-axis direction. The developer pressure in the Y-axis direction is perpendicular to the blade mounting surface 41*s* of the developing device frame 30. That is, the developer pressure in the Y-axis direction acts as a force in a direction of peeling the doctor blade 36 off the blade mounting surface 41*s*. The adhesive A therefore may desirably have a bonding force sufficiently greater than the developer pressure in the Y-axis direction. The adhesion area and the application thickness of the adhesive A to the blade mounting surface 41*s* are thus optimized by taking into account the force of the developer pressure to peel the doctor blade 36 off the blade mounting surface 41*s* and the adhesive strength of the adhesive A.

(Configuration of Developing Device According to First Example Embodiment)

As described above, the developing device 3 including the resin-made doctor blade 36 and the resin-made developing device frame 30 can be configured such that the resin-made doctor blade 36 is mounted on and fixed to the blade mounting portion 41 of the resin-made developing device frame 30.

As described above, the longitudinal length of the maximum image region of the doctor blade 36 increases as the width of the sheet S to form an image increases. As the longitudinal length of the maximum image region of the doctor blade 36 increases, the longitudinal length of the blade mounting surface 41*s* increases.

If a developing device frame 30 having a longitudinally long blade mounting surface 41*s* is molded of resin, the blade mounting surface 41*s* is likely to increase in unevenness, and the flatness (Japanese Industrial Standards (JIS) B 0021) of the blade mounting surface 41*s* tends to increase. The reason is that, typically, the greater the longitudinal length of a resin molded article, the more easily flatness variations occur longitudinally over the resin molded article. The greater the flatness of the blade mounting surface 41*s*, the greater the amount of variation in the relative position of the doctor blade 36 to the developing sleeve 70 tends to be when the doctor blade 36 is mounted on the blade mounting surface 41*s*. The relative position of the doctor blade 36 to the developing sleeve 70 when the doctor blade 36 is mounted on the blade mounting surface 41*s* includes the position where the doctor blade 36 is closest to the developing sleeve 70.

Suppose that the amount of variation in the relative position of the doctor blade 36 to the developing sleeve 70 when the doctor blade 36 is mounted on the blade mounting surface 41*s* is large. The larger the amount of variation in the relative position of the doctor blade 36 to the developing sleeve 70, the more likely the size of the SB gap G in the state that the doctor blade 36 is fixed to the blade mounting surface 41*s* is to vary longitudinally over the developing sleeve 70. If the size of the SB gap G varies longitudinally over the developing sleeve 70, the amount of the developer carried on the surface of the developing sleeve 70 can be uneven longitudinally over the developing sleeve 70.

If the resin-made doctor blade 36 is configured to be fixed to the blade mounting portion 41 of the resin-made developing device frame 30, the SB gap G may desirably fall within a predetermined range longitudinally over the developing sleeve 70 regardless of the flatness of the blade mounting surface 41*s*.

For that purpose, the first example embodiment employs the following configuration. The configuration is intended to reduce discrepancy of the values of the SB gap measured by cameras or transmission sensors from the actual value of the SB gap when the relative position of the regulating blade to the developing sleeve varies due to the flatness of the blade mounting surface of the developing device frame. In other words, the first example embodiment provides a developing device that can reduce discrepancy of the measured values of the SB gap from the actual value of the SB gap even if the relative position of the regulating blade to the developing sleeve varies due to the flatness of the blade mounting surface of the developing device frame. Details will be described below.

Figure 12:
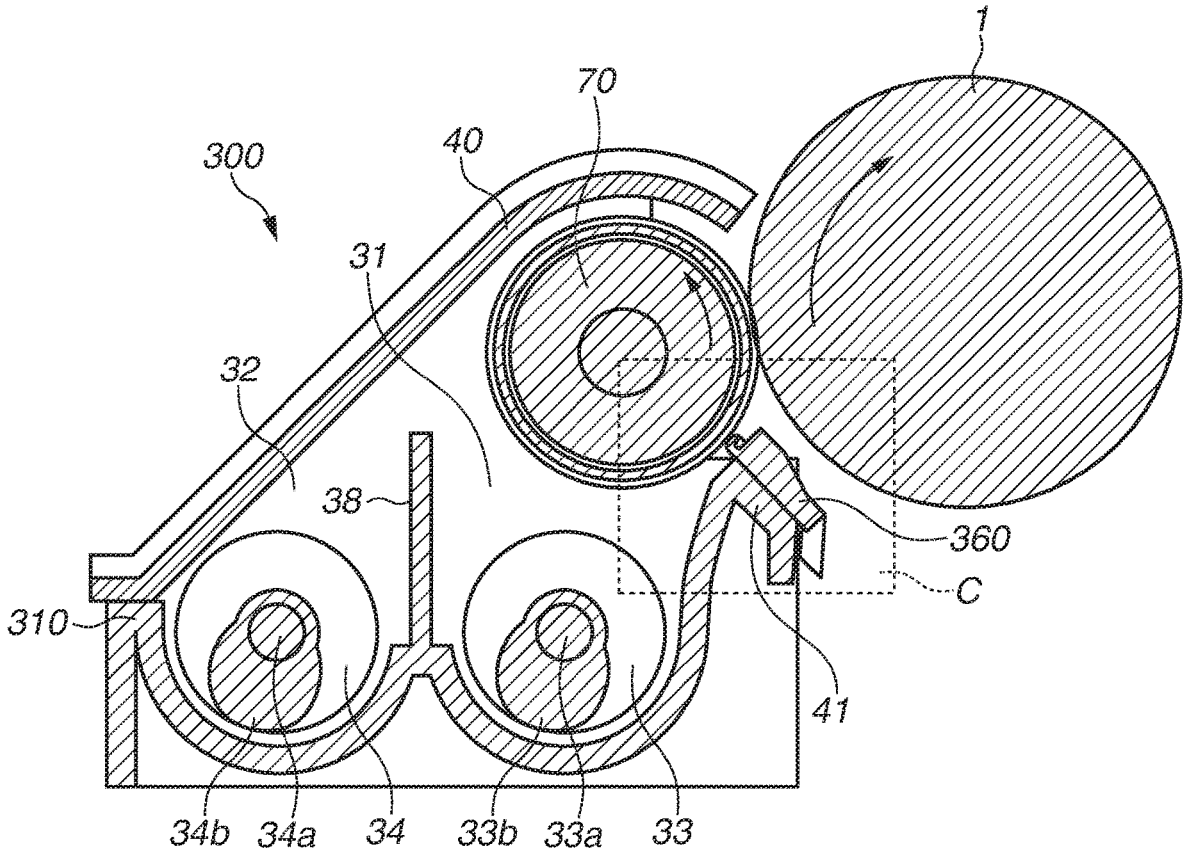
FIG. 12 is a sectional view illustrating a configuration of a developing device according to a first example embodiment.
Figure 13:
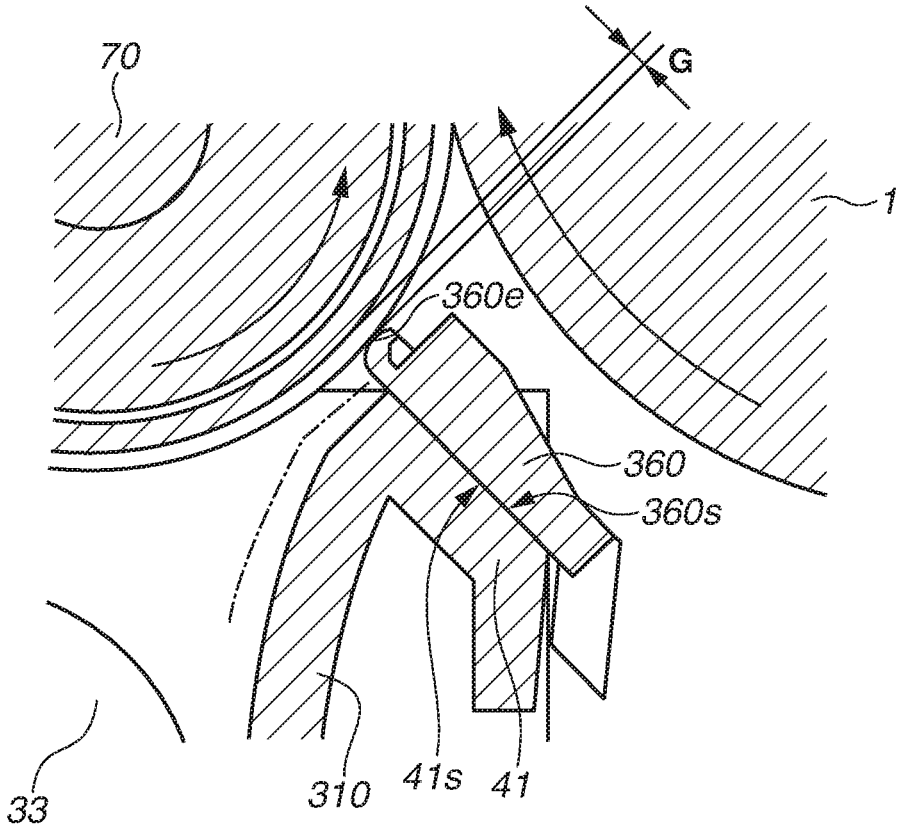
FIG. 13 is an enlarged view illustrating the configuration of the developing device according to the first example embodiment.

A configuration of the developing device according to the first example embodiment will be described with reference to the sectional view of FIG. 12 and the enlarged view of FIG. 13. FIG. 12 is a sectional view of a developing device 300 seen in a cross section orthogonal to the rotation axis of a developing sleeve 70. FIG. 13 is an enlarged view of the developing device 300 in a sectional area C of FIG. 12 (near a doctor blade 360). In FIGS. 12 and 13, components similar to those illustrated in FIGS. 2, 3, and 4 are designated by the same respective reference numerals. The following description mainly deals with differences of the configuration of the developing device 300 according to the first example embodiment from the configuration of the developing device 3 described above with reference to FIGS. 2, 3, and 4.

In the first example embodiment, a developing device frame 310 is installed in the developing device 300 in such an orientation that the blade mounting surface 41*s* becomes substantially parallel to an installation surface (horizontal surface) of a blade mounting apparatus in mounting and fixing the doctor blade 360 onto the blade mounting surface 41*s*.

Figure 15:
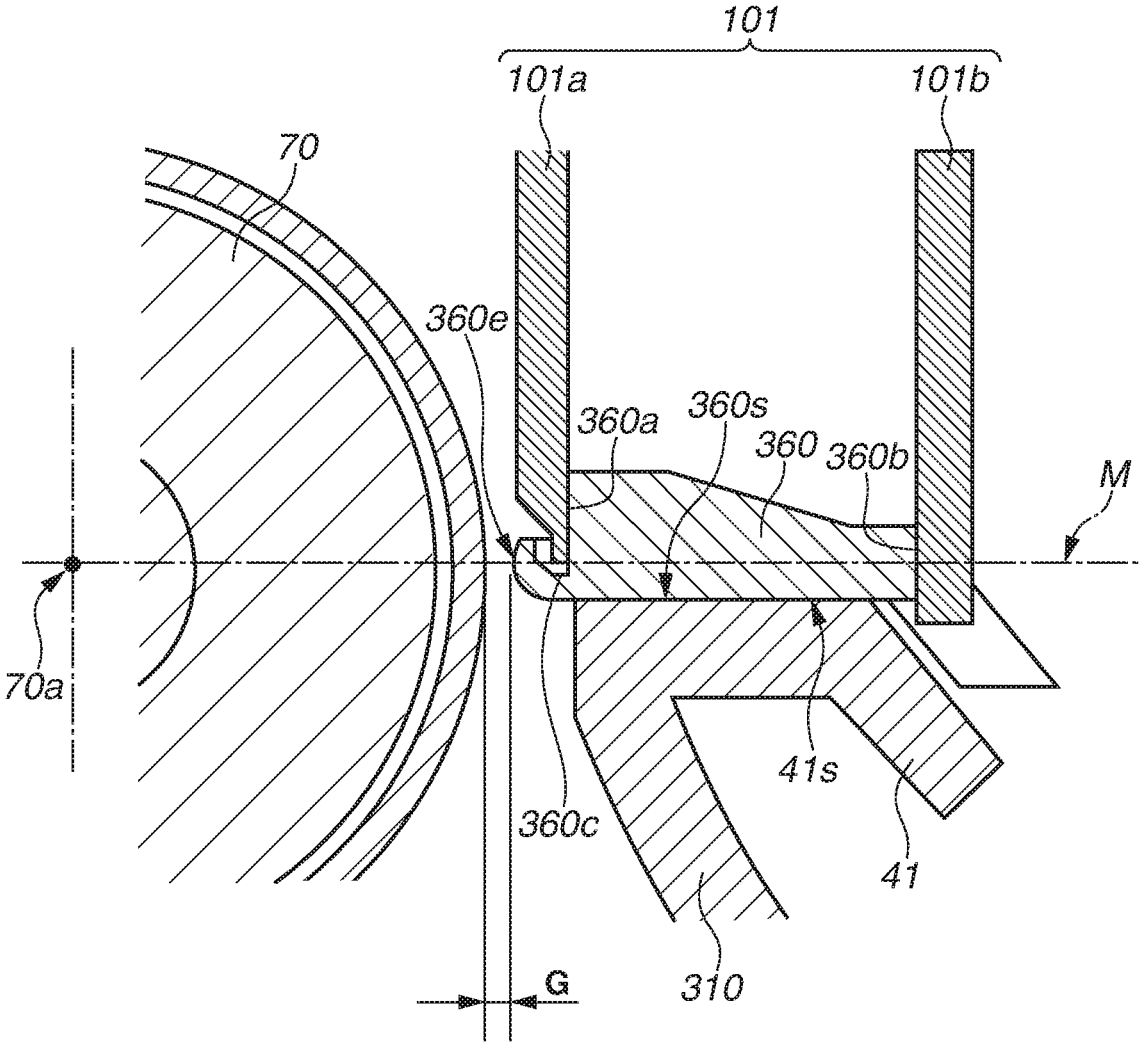
FIG. 15 is an enlarged view for describing an orientation of the resin-made doctor blade during mounting.
Figure 16:
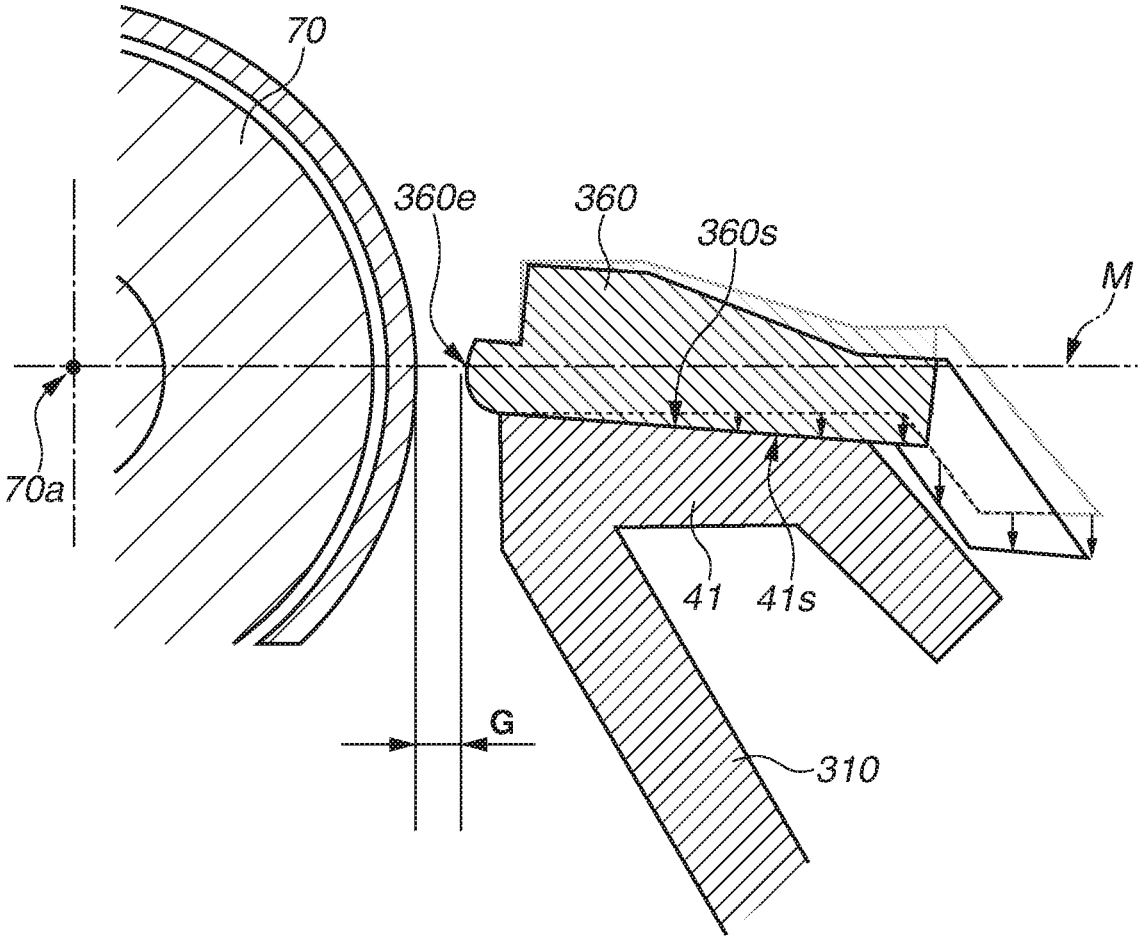
FIG. 16 is an enlarged view for describing the orientation of the resin-made doctor blade during mounting.

A configuration of the blade mounting apparatus will be described with reference to the schematic diagram of FIG. 14. The orientation of the doctor blade 360 during mounting (the relative position of the doctor blade 360 to the developing sleeve 70 when the doctor blade 360 is mounted on the blade mounting surface 41*s*) will be described with reference to the enlarged views of FIGS. 15 and 16. FIGS. 15 and 16 are each a sectional view of the developing device 300 seen in a cross section orthogonal to the rotation axis of the developing sleeve 70. FIGS. 15 and 16 each illustrate a state where the orientation of the developing device frame 310 is changed such that the blade mounting surface 41*s* illustrated in the sectional view of FIG. 12 becomes substantially parallel to the installation surface (horizontal surface) of the blade mounting apparatus.

Figure 14:
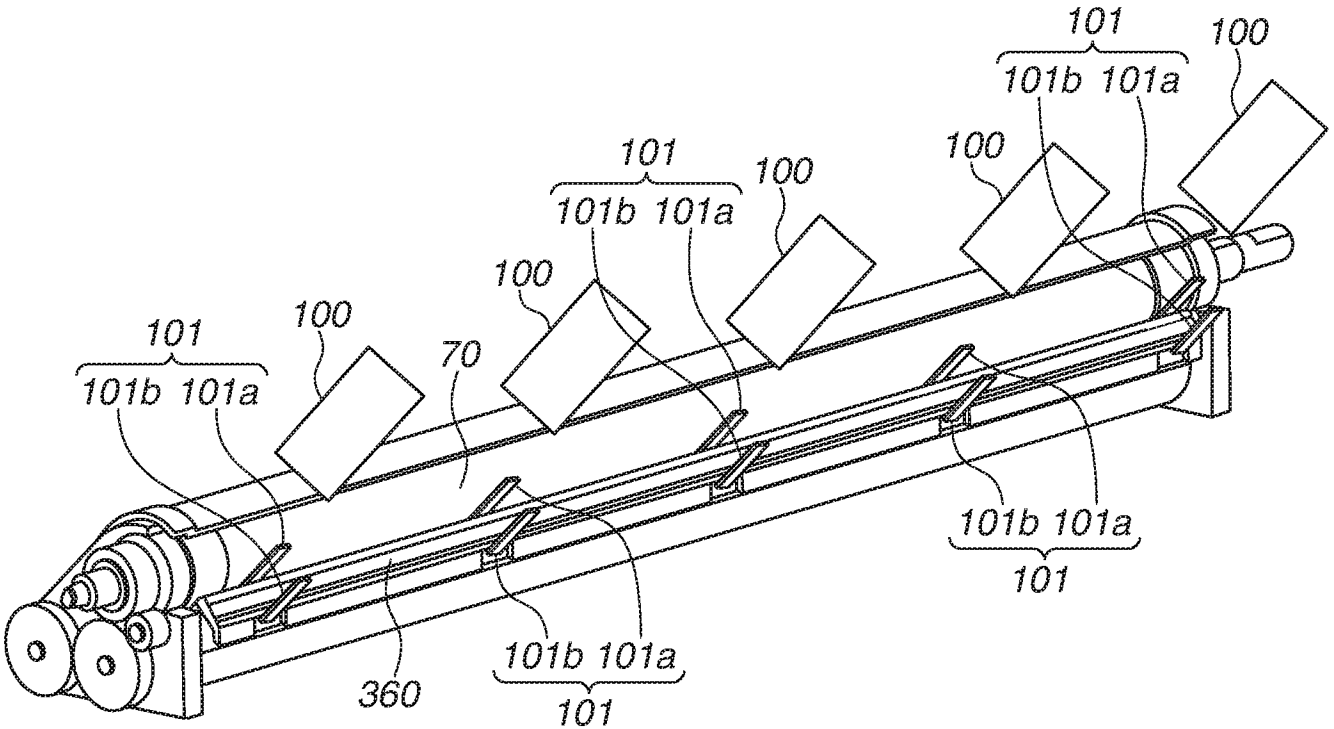
FIG. 14 is a schematic diagram illustrating a configuration of an apparatus for mounting the resin-made doctor blade.

As illustrated in FIG. 14, the blade mounting apparatus includes cameras 100 at five positions in the rotation axis direction of the developing sleeve 70. The five cameras 100 can measure the size of the SB gap G at edge portions 360*e* (360*e*1 to 360*e*5) of the doctor blade 360 at the respective positions. The edge portions 360*e* (360*e*1 to 360*e*5) of the doctor blade 360 are located at positions where the doctor blade 360 comes closest to the developing sleeve 70 when the doctor blade 360 is mounted on the blade mounting surface 41*s*.

The cameras 100 are installed with their installation axes substantially orthogonal to a line M connecting a rotation center 70*a* of the developing sleeve 70 and each edge portion 360*e* of the doctor blade 360 (position where the doctor blade 360 is closest to the developing sleeve 70). The cameras 100 measure the size of the SB gap G in such a manner. The line M is substantially parallel to the installation surface (horizontal surface) of the blade mounting apparatus.

As illustrated in FIG. 14, the blade mounting apparatus includes gripping units 101 at respective positions corresponding to the five cameras 100. The gripping units 101 each include a first gripping member 101*a* and a second gripping member 101*b* for gripping the doctor blade 360. As illustrated in FIG. 15, the first gripping members 101*a* grip a first perpendicular surface 360*a* of the doctor blade 360 perpendicular to the line M, and the second gripping members 101*b* grip a second perpendicular surface 360*b* of the doctor blade 360 perpendicular to the line M. The first perpendicular surface 360*a* is substantially parallel to the second perpendicular surface 360*b*. The first perpendicular surface 360*a* is located closer to the developing sleeve 70 than the second perpendicular surface 360*b* is. The gripping units 101 grip the doctor blade 360 by sandwiching the first and second perpendicular surfaces 360*a* and 360*b* of the doctor blade 360 between the griping members 101*a* and 101*b*.

FIG. 14 illustrates an example where the blade mounting apparatus includes the five cameras 100 and the five gripping units 101 that are spaced from each other in the rotation axis direction of the developing sleeve 70. However, such an example is not restrictive. The numbers of cameras 100 and gripping units 101 may be set as appropriate based on the desirable precision of the SB gap G.

The five cameras 100 detect the surface of the developing sleeve 70 and the respective edge portions 360*e* of the doctor blade 360 gripped by the gripping units 101, and the size of the SB gap G at the five positions is calculated from the position measurements. Based on the calculations of the size of the SB gap G, the five gripping units 101 are each moved in the direction of the line M and the size of the SB gap G is adjusted to a desired size (in the first example embodiment, 300 μm). From the viewpoint of adjustment precision of the size of the SB gap G, the step of adjusting the size of the SB gap G is desirably performed immediately before a to-be-mounted surface (pasting surface) 360*s* of the doctor blade 360 is mounted on (brought into contact with) the blade mounting surface 41*s*. The reason is that if the surface of the developing sleeve 70 and the edge portions 360*e* of the doctor blade 360 are at different distances from the cameras 100, a positional measurement error can occur, resulting in a drop in the adjustment precision of the size of the SB gap G. In the first example embodiment, the cameras 100 are described to be used as the means for measuring the size of the SB gap G. However, sensors other than the cameras 100 (for example, transmission sensors) may be used to measure the size of the SB gap G.

The doctor blade 360 adjusted to the desired size of the SB gap G by performing the foregoing step of adjusting the size of the SB gap G is pressed against and bonded to the blade mounting surface 41*s*, to which the adhesive A is applied in advance, with a predetermined load. However, even if the size of the SB gap G is adjusted to a desired size in the step of adjusting the SB gap G, there are factors that can change the size of the SB gap G when the blade mounting surface 41*s* of the developing device frame 310 and the to-be-mounted surface 360*s* of the doctor blade 360 are bonded by pressure. Such factors are described below.

As described above, the doctor blade 360 is made of resin, and the developing device frame 310 is made of resin. In other words, both the to-be-mounted surface 360*s* of the doctor blade 360 and the blade mounting surface 41*s* of the developing device frame 310 are a portion of a resin part. As long as the doctor blade 360 and the developing device frame 310 have the precision of ordinary resin molded articles, the to-be-mounted surface 360*s* of the doctor blade 360 and the blade mounting surface 41*s* of the developing device frame 310 may not be substantially parallel to each other depending on the resin molding conditions and contraction conditions.

For example, suppose, as illustrated in FIG. 16, that the blade mounting surface 41*s* is tilted at a predetermined angle to the line M. In such a case, the to-be-mounted surface 360*s* of the doctor blade 360 mounted on the blade mounting surface 41*s* tilted from the line M is bonded to the developing device frame 310 at a predetermined tilt to the line M to follow the tilt of the blade mounting surface 41*s*. That is, despite the adjustment to the size of the SB gap G, the doctor blade 360 is fixed (bonded) to the blade mounting surface 41*s* at a predetermined tilt to the line M. As a result, the orientation of the doctor blade 360 is tilted and the edge portions 360*e* of the doctor blade 360 (relative position of the doctor blade 360 to the developing sleeve 70) vary in position. This makes the value of the SB gap G after bonding different from the adjusted size of the SB gap G.

A relationship between the value of the SB gap measured by a camera 100 and the actual value of the SB gap when the doctor blade 360 is mounted on the blade mounting surface 41*s* tilted from the line M will now be described with reference to FIGS. 17A and 17B.

Figure 17A:
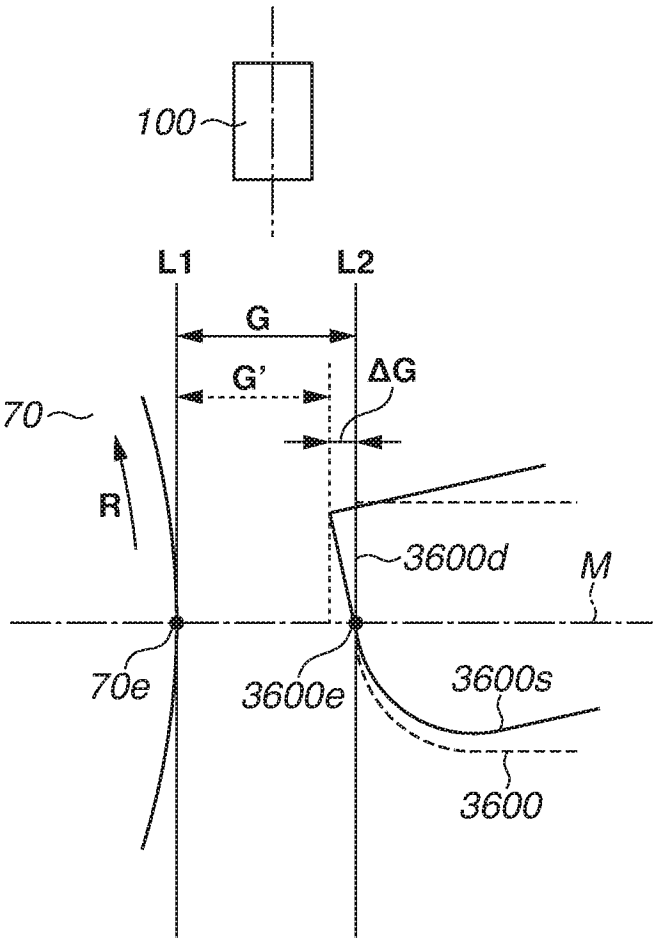
FIGS. 17A and 17B are schematic diagrams illustrating configurations of resin-made doctor blades according to a comparative example and the first example embodiment.

FIG. 17A illustrates a doctor blade 3600 according to a comparative example. FIG. 17B illustrates the doctor blade 360 according to the first example embodiment. Unlike the doctor blade 3600 illustrated in FIG. 17A, the doctor blade 360 illustrated in FIG. 17B has a cutout 360*c*. The cutout 360*c* is located downstream of a position where the doctor blade 360 is closest to the developing sleeve 70 in the rotation direction R of the developing sleeve 70.

As illustrated in FIG. 17A, the greater the tilt of the blade mounting surface 41*s* to the line M is, the greater the amount of variation in the relative position of the doctor blade 3600 to the developing sleeve 70 is when the doctor blade 3600 is mounted on the blade mounting surface 41*s*. This means that the greater the tilt of the blade mounting surface 41*s* to the line M is, the higher the degree of discrepancy of the value of an SB gap G' measured by the camera 100 from the actual value of the SB gap G is when the doctor blade 3600 is mounted on the blade mounting surface 41*s*.

Here, the camera 100 is unable to measure a position 3600*c* where the doctor blade 3600 is closest to the developing sleeve 70. Instead, the camera 100 measures a region (region 3600*d*) downstream of the position 3600*e* where the doctor blade 3600 is closest to the developing sleeve 70 in the rotation direction R of the developing sleeve 70. The value of the SB gap G' measured by the camera 100 is thus smaller than the actual value of the SB gap G. The amount of change in the size of the SB gap (i.e., the absolute value of the difference between the value of the SB gap G' measured by the camera 100 and the actual value of the SB gap G) will be defined as "ΔG".

Figure 17B:
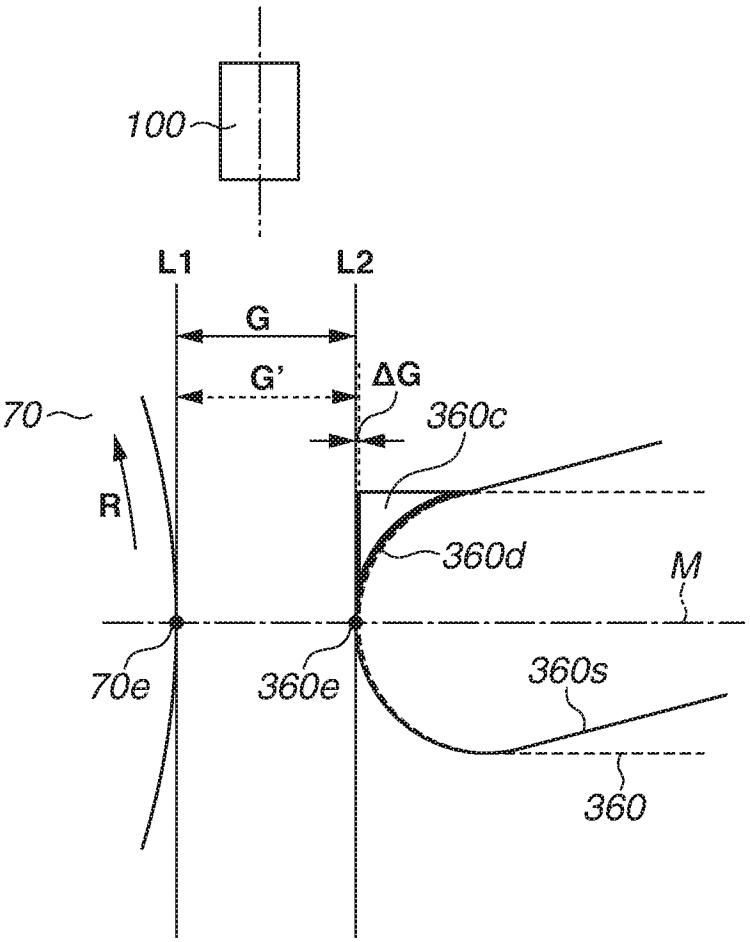

As illustrated in FIG. 17B, assume a tangent L1 to the developing sleeve 70 at a position 70*e* where the developing sleeve 70 is closest to the doctor blade 360. A line that is parallel to the tangent L1 and passes through a position 360*e* where the doctor blade 360 is closest to the developing sleeve 70 will be referred to as a line L2. The position 360*e* where the doctor blade 360 is closest to the developing sleeve 70 will be referred to as a point of origin. The cutout 360*c* is formed over the entirety of a region up to at least 0.5 mm from the point of origin (position 360*e* where the doctor blade 360 is closest to the developing sleeve 70) along the line L2 downstream in the rotation direction R of the developing sleeve 70.

The reason why the cutout 360*c* is formed over the entirety of the region up to at least 0.5 mm from the position 360*e* where the doctor blade 360 is closest to the developing sleeve 70 along the line L2 downstream in the rotation direction of the developing sleeve 70 will now be described.

As described above, in the first example embodiment, the doctor blade 360 is substantially opposed to a peak position where the magnetic flux density of a predetermined magnetic pole (regulation pole) of the magnet roll peaks. In the first example embodiment, a part tolerance of up to ±3° is allowed for the peak position of the magnetic flux density of the regulation pole of the magnet roll. For example, if a developing sleeve 70 having a diameter of 18 mm is used, the peak position of the magnetic flux density of the regulation pole of the magnet roll fixed inside the developing sleeve 70 having a diameter of 18 mm can deviate up to approximately 0.47 mm within the tolerance. In other words, the relative position of the position 360*e* where the doctor blade 360 is closest to the developing sleeve 70 to the peak position of the magnetic flux density of the regulation pole deviates up to approximately 0.5 mm from the point of origin along the line L2 downstream in the rotation direction R of the developing sleeve 70.

In the first example embodiment, the cutout 360*c* is formed over the entirety of the region up to at least 0.5 mm from the point of origin along the line L2 downstream in the rotation direction R of the developing sleeve 70. This can absorb a deviation (deviation of up to approximately 0.5 mm) in the relative position of the position 360*e* where the doctor blade 360 is closest to the developing sleeve 70 to the peak position of the magnetic flux density of the regulation pole due to the part tolerance for the peak position of the magnetic flux density of the regulation pole of the magnet roll. Consequently, if the relative position of the position 360*e* where the doctor blade 360 is closest to the developing sleeve 70 to the peak position of the magnetic flux density of the regulation pole deviates, the value of the SB gap G' measured by the camera 100 can be prevented from departing from the actual value of the SB gap G.

As described above, in the first example embodiment, the doctor blade 360 is flexed to correct the straightness of the doctor blade 360. To reduce the rigidity of the doctor blade 360 (by itself) so that the doctor blade 360 can be flexed, the doctor blade 360 is given a basic thickness of 1.0 mm or more and 3.0 mm or less. In the example of FIG. 17B, the basic thickness of the doctor blade 360 is set to 1.6 mm. In the first example embodiment, the length of the cutout 360*c* in the direction perpendicular to the line L2 (hereinafter, referred to as the cut amount of the cutout 360*c*) at a position 0.5 mm from the point of origin along the line L2 downstream in the rotation direction R of the developing sleeve 70 is set as follows: The cut amount of the cutout 360*c* is appropriately set by taking into account the tilt angle of the blade mounting surface 41*s* to the line M, an allowable size of ΔG, and the minimum thickness and basic thickness of the resin molded article during resin molding. Specifically, if 0.2 mm of flash is allowed in resin-molding the doctor blade 360 using a mold (split mold), a cutout 360*c* having a cut amount of 0.3 mm or more may be desirable in view of a flash margin.

For example, suppose that the blade mounting surface 41*s* can tilt at an angle of up to ±50 to the line M and the allowable size of ΔG is ±5 μm. In such a case, the cut amount of the cutout 360*c* is desirably set to 0.3 mm or more. Suppose, for example, that the blade mounting surface 41*s* can tilt at an angle of up to ±10° to the line M and the allowable size of ΔG is ±5 m. In such a case, since the assumed possible tilt angle of the blade mounting surface 41*s* to the line M is increased from "+5°" to "10°", i.e., doubled in magnitude, the cut amount of the cutout 360*c* may desirably be set to 0.6 mm or more.

In the region up to at least 0.5 mm from the point of origin along the line L2 downstream in the rotation direction R of the developing sleeve 70, the cut amount of the cutout 360*c* desirably increases downstream in the rotation direction R of the developing sleeve 70 at a gradually increasing rate. The reason is that such a smooth cutout 360*c* can provide more latitude to the tilt of the blade mounting surface 41*s* to the line M in capturing the SB gap G' by the camera 100, compared to a straight cutout.

As described above, in the first example embodiment, the doctor blade 360 has the cutout 360*c* downstream of the position where the doctor blade 360 is closest to the developing sleeve 70 in the rotation direction R of the developing sleeve 70, and the cut amount of the cutout 360*c* is appropriately set.

More specifically, a position of the regulating blade where the regulating blade is closest to the developer bearing member when the developing device is seen in a cross section orthogonal to the rotation axis of the developer bearing member will be referred to as a "first position". A position of the regulating blade 0.5 mm downstream of the "first position" in the rotation direction of the developer bearing member when the developing device is seen in the cross section orthogonal to the rotation axis of the developer bearing member will be referred to as a "second position". A "cutout" is formed over the entirety of the region from the "first position" to the "second position" in the rotation direction of the developer bearing member when the developing device is seen in the cross section orthogonal to the rotation axis of the developer bearing member. The "cut amount" of the "cutout" at the "second position" in the rotation direction of the developer bearing member is 0.3 [mm] or more.

Such a configuration can reduce the degree of discrepancy of the value of the SB gap G' measured by the camera 100 from the actual value of the SB gap G when the doctor blade 360 is mounted on the blade mounting surface 41*s* regardless of the tilt of the blade mounting surface 41*s* to the line M. According to the first example embodiment described above, the measured value of the SB gap can be prevented from departing from the actual value of the SB gap if the relative position of the doctor blade 360 to the developing sleeve 70 varies due to the flatness of the blade mounting surface 41*s* of the developing device frame 310.

In the foregoing first example embodiment, the amount of variation in the relative position of the doctor blade 360 to the developing sleeve 70 is assumed to increase when the doctor blade 360 is mounted on the blade mounting surface 41*s*, because the blade mounting surface 41*s* has a high flatness. As described above, the cameras 100 or sensors other than the cameras 100 (for example, transmission sensors) are assumed to be used as the means for measuring the size of the SB gap G.

The installation angle of the developing device frame 310 can change when the developing device frame 310 is installed on a tool (adjustment tool) for adjusting the size of the SB gap G. If the installation angle of the developing device frame 310 changes upon installation of the developing device frame 310 on the adjustment tool, the cameras 100 measure the size of the SB gap G in a state where the measurement axes of the cameras 100 are off the perpendicular to the line M by some angle. Originally, in measuring the size of the SB gap G with the cameras 100, the cameras 100 may desirably measure the SB gap G along the perpendicular to the line M.

A relationship between the value of the SB gap G measured by a camera 100 and the actual value of the SB gap G when the doctor blade 360 is mounted on the blade mounting surface 41*s* without the measurement axis of the camera 100 on the perpendicular to the line M will be described with reference to FIGS. 18A and 18B.

Figure 18A:
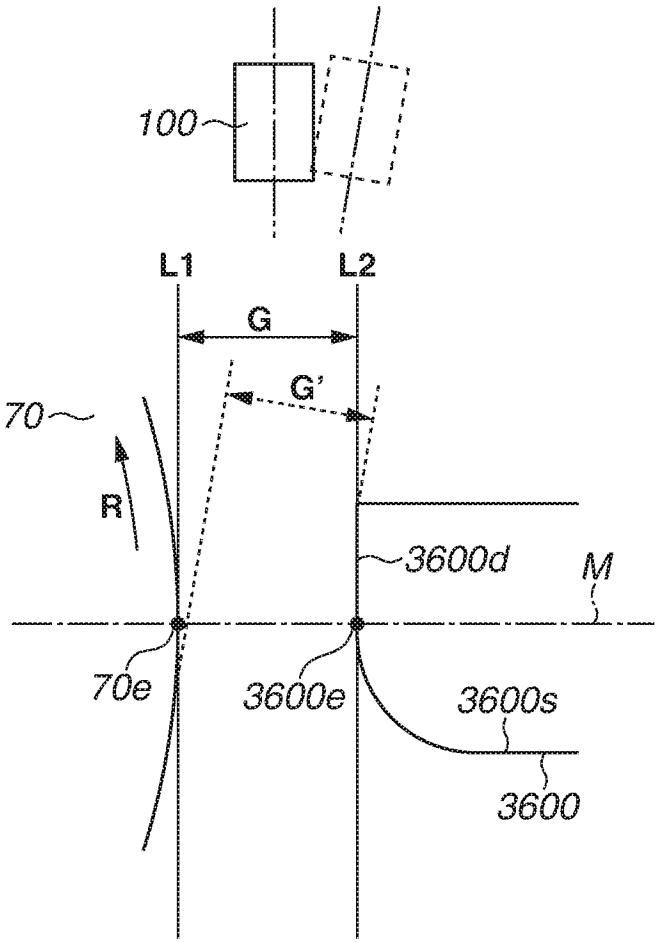
FIGS. 18A and 18B are schematic diagrams illustrating configurations of resin-made doctor blades according to a comparative example and a second example embodiment.
Figure 18B:
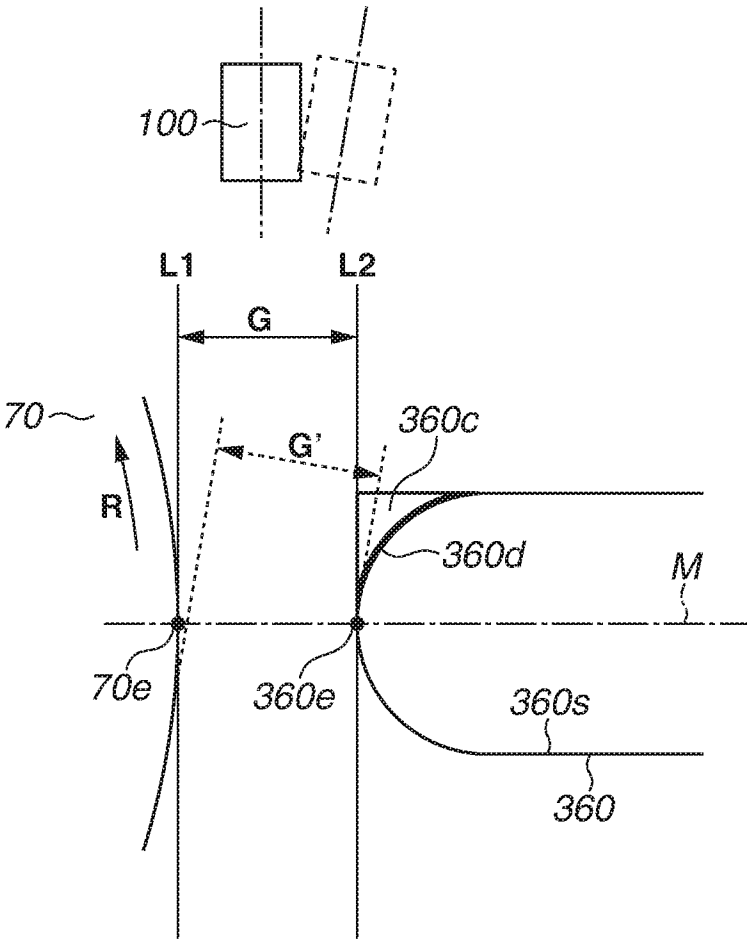

FIG. 18A illustrates a doctor blade 3600 according to a comparative example. FIG. 18B illustrates a doctor blade 360 according to a second example embodiment. Unlike the doctor blade 3600 illustrated in FIG. 18A, the doctor blade 360 illustrated in FIG. 18B has a cutout 360*c*. The cutout 360*c* is located downstream of a position where the doctor blade 360 is closest to the developing sleeve 70 in the rotation direction R of the developing sleeve 70.

Suppose, for example, that the blade mounting surface 41*s* is at an angle to the line M as illustrated in FIG. 18A. In such a case, the doctor blade 3600 is bonded to the developing device frame 310 at an angle such that the surface of the doctor blade 3600 to be mounted on the blade mounting surface 41*s* (to-be-mounted surface 3600*s* of the doctor blade 3600) follows the shape of the blade mounting surface 41*s*. In such a case, since the measurement axis of the camera 100 is not on the perpendicular to the line M, the value of the SB gap G' measured by the camera 100 when the doctor blade 3600 is mounted on the blade mounting surface 41*s* departs from the actual value of the SB gap G.

Here, the camera 100 is unable to measure a position 3600*e* where the doctor blade 3600 is closest to the developing sleeve 70. Instead, the camera 100 measures a region (region 3600*d*) downstream of the position 3600*e* where the doctor blade 3600 is closest to the developing sleeve 70 in the rotation direction R of the developing sleeve 70. The value of the SB gap G' measured by the camera 100 is thus smaller than the actual value of the SB gap G.

In the second example embodiment, like the first example embodiment, the doctor blade 360 has the cutout 360*c* downstream of the position where the doctor blade 360 is closest to the developing sleeve 70 in the rotation direction R of the developing sleeve 70. The length of the cutout 360*c* in the direction perpendicular to the line L2 (cut amount of the cutout 360*c*) at the position 0.5 mm from the point of origin along the line L2 downstream in the rotation direction R of the developing sleeve 70 is set as follows: The cut amount of the cutout 360*c* is appropriately set by taking into account an angular deviation of the measurement axis of the camera 100 from the perpendicular to the line M, the allowable size of ΔG, and the minimum thickness and basic thickness of the resin molded article during resin molding. Specifically, if 0.2 mm of flash is allowed in resin-molding the doctor blade 360 using a mold (split mold), a cutout 360*c* having a cut amount of 0.3 mm or more may be desirable in view of a flash margin.

For example, suppose that the measurement axis of the camera 100 can deviate up to ±50 in angle from the perpendicular to the line M and the allowable size of ΔG is ±5 μm. In such a case, the cut amount of the cutout 360*c* is desirably set to 0.3 mm or more.

For example, suppose that the measurement axis of the camera 100 can deviate up to ±10° in angle from the perpendicular to the line M and the allowable size of ΔG is ±5 μm. In such a case, since the assumed possible angular deviation of the measurement axis of the camera 100 from the perpendicular to the line M is increased from "+5°" to "+10°", i.e., doubled in magnitude, the cut amount of the cutout 360*c* may desirably be set to 0.6 mm or more.

In the region up to at least 0.5 mm from the point of origin along the line L2 downstream in the rotation direction R of the developing sleeve 70, the cut amount of the cutout 360*c* desirably increases downstream in the rotation direction R of the developing sleeve 70 at a gradually increasing rate. Such a smooth cutout 360*c* can provide more latitude to the angular deviation of the measurement axis of the camera 100 from the perpendicular to the line M when the SB gap G' is captured by the camera 100, compared to a straight cutout.

As described above, in the second example embodiment, the doctor blade 360 has the cutout 360*c* downstream of the position where the doctor blade 360 is closest to the developing sleeve 70 in the rotation direction R of the developing sleeve 70, and the cut amount of the cutout 360*c* is appropriately set. In the second example embodiment, the following can thus be achieved regardless of the angular deviation of the measurement axis of the camera 100 from the perpendicular to the line M: In the second example embodiment, the degree of discrepancy of the value of the SB gap G' measured by the camera 100 from the actual value of the SB gap G when the doctor blade 360 is mounted on the blade mounting surface 41*s* can be reduced.

According to the second example embodiment described above, the measured value of the SB gap can be prevented from departing from the actual value of the SB gap even if the measurement axis of the camera 100 deviates in angle from the perpendicular to the line M.

Other Example Embodiments

The present disclosure is not limited to the foregoing example embodiments. Various modifications (including organic combinations of the example embodiments) can be made based on the gist of the present disclosure, and such modifications are not excluded from the scope of the present disclosure.

In the foregoing example embodiments, as illustrated in FIG. 1, the image forming apparatus 60 configured to use the ITB 61 as an intermediate transfer member has been described as an example. However, this is not restrictive. Example embodiments of the present disclosure can also be applied to an image forming apparatus configured to successively bring a recording medium into direct contact with the photosensitive drums 1 for transfer.

In the foregoing example embodiments, the developing device 300 is described to be a single unit. However, similar effects can also be obtained from a process cartridge into which an image forming unit 600 (see FIG. 1) including the developing device 300 is integrated and which is configured to be detachably attachable to the image forming apparatus 60. Example embodiment of the present disclosure are applicable to an image forming apparatus 60 including such a developing device 300 or a process cartridge, whether a monochrome image forming apparatus or a color image forming apparatus.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-228343, filed Dec. 5, 2018, which is hereby incorporated by reference herein in its entirety.

What is claimed is:

1. A developing device comprising:

a rotatable developing member configured to carry and feed a developer including toner and a carrier toward a position where an electrostatic image formed on an image bearing member is developed;

a resin-made regulating blade opposed to the rotatable developing member and configured to regulate an amount of the developer carried on the rotatable developing member; and a resin-made developing device frame configured separately from the regulating blade, the developing device frame including a mounting portion on which the regulating blade is mounted, wherein when the developing device is seen in a cross section orthogonal to a rotation axis of the rotatable developing member, the regulating blade has a cutout across an entirety of a region from a first position where the regulating blade is closest to the rotatable developing member to a second position 0.5 mm downstream of the regulating blade from the first position in a rotation direction of the rotatable developing member, and wherein a cut amount of the cutout at the second position is 0.3 mm or more.

2. The developing device according to claim 1, wherein when the developing device is seen in the cross section orthogonal to the rotation axis of the rotatable developing member, the cut amount of the cutout at the second position is 0.6 mm or more.

3. The developing device according to claim 1, wherein the regulating blade has a thickness of 1.0 mm or more and 3.0 mm or less.

4. The developing device according to claim 1, wherein the regulating blade is fixed to the mounting portion in a state that the regulating blade is flexed so that a gap between the rotatable developing member and the regulating blade falls within a predetermined range over an entirety of a region of the regulating blade corresponding to a maximum image region where an image is formable on the image bearing member.

5. The developing device according to claim 4, wherein in a state that the gap falls within the predetermined range over the entirety of the region of the regulating blade corresponding to the maximum image region of the image bearing member, formulae shown below are satisfied, $$0.9\times g_1 \leq g_{target} \leq 1.1\times g_1,$$

$$0.9\times g_2 \leq g_{target} \leq 1.1\times g_2, \text{ and}$$

$$0.9\times g_3 \leq g_{target} \leq 1.1\times g_3,$$

where a definition of $g_1$, $g_2$, $g_3$, and $g_{target}$ is given as follows:

$g_1$ is the gap at a first portion of the region of the regulating blade corresponding to the maximum image region of the image bearing member, $g_2$ is the gap at a second portion of the region of the regulating blade corresponding to the maximum image region of the image bearing member, $g_3$ is the gap at a third portion of the region of the regulating blade corresponding to the maximum image region of the image bearing member, and $g_{target}$ is a target value of the gap.

6. The developing device according to claim 1, wherein the regulating blade is fixed to the mounting portion with an adhesive over a substantial entirety of a region of the regulating blade corresponding to a maximum image region where an image is formable on the image bearing member.

7. The developing device according to claim 1, wherein the regulating blade has a rigidity capable of being flexed.

* * * * *